US008406988B2

(12) United States Patent
Schäfer et al.

(10) Patent No.: US 8,406,988 B2
(45) Date of Patent: Mar. 26, 2013

(54) COMPUTER-IMPLEMENTED METHOD FOR ENSURING THE PRIVACY OF A USER, COMPUTER PROGRAM PRODUCT, DEVICE

(75) Inventors: Jörg Schäfer, Frankfurt (DE); David Toma, Karlsruhe (DE)

(73) Assignee: Accenture Global Services Limited, Dublin (IE)

( * ) Notice: Subject to any disclaimer, the term of this patent is extended or adjusted under 35 U.S.C. 154(b) by 577 days.

(21) Appl. No.: 12/653,976

(22) Filed: Dec. 18, 2009

(65) Prior Publication Data

US 2011/0054767 A1 Mar. 3, 2011

(30) Foreign Application Priority Data

Aug. 31, 2009 (EP) ..... 09011182

(51) Int. Cl.
*G08G 1/00* (2006.01)

(52) U.S. Cl. ..... 701/119; 340/908; 340/936

(58) Field of Classification Search ..... 703/117–119, 703/2; 340/907, 908, 917, 933, 935, 936; 709/203; 713/150; 715/742; 701/117–119, 701/532

See application file for complete search history.

(56) References Cited

U.S. PATENT DOCUMENTS

| | | | | |
|---|---|---|---|---|
| 5,797,134 | A * | 8/1998 | McMillan et al. | 705/400 |
| 6,690,294 | B1 * | 2/2004 | Zierden | 340/937 |
| 7,174,243 | B1 | 2/2007 | Lightner et al. | |
| 7,228,211 | B1 | 6/2007 | Lowrey et al. | |
| 7,302,369 | B2 * | 11/2007 | Wren | 703/2 |
| 7,348,895 | B2 * | 3/2008 | Lagassey | 340/907 |
| 7,791,503 | B2 * | 9/2010 | Breed et al. | 340/993 |
| 7,983,835 | B2 * | 7/2011 | Lagassey | 701/117 |
| 2003/0130893 | A1 | 7/2003 | Farmer | |
| 2005/0021223 | A1 | 1/2005 | Heaps et al. | |
| 2006/0089787 | A1 * | 4/2006 | Burr et al. | 701/202 |
| 2006/0206246 | A1 * | 9/2006 | Walker | 701/16 |
| 2007/0225912 | A1 | 9/2007 | Grush | |

(Continued)

FOREIGN PATENT DOCUMENTS

| | | |
|---|---|---|
| DE | 10 2008 017 568 A1 | 4/2009 |
| EP | 1 376 478 | 1/2004 |

(Continued)

OTHER PUBLICATIONS

Isumi, Michiko, et al., "*Requirements for Protection Methods of Personal Information in Vehicle Probing System*" Proceedings of the 2007 International Symposium Applications and the Internet Workshops, (Saint Workshops 2007), Jan. 1, 2007, (4p).

(Continued)

*Primary Examiner* — Russell Frejd
(74) *Attorney, Agent, or Firm* — Finnegan, Henderson, Farabow, Garrett & Dunner, LLP

(57) ABSTRACT

A computer-implemented method and product ensures the privacy of a user and the utility of data communicated by a device, such as a vehicle telematics device, to a server, comprising receiving data at the device during the time period; processing, by the device, the received data; summarizing, by the device, the processed data in a matrix, wherein the rows and columns of the matrix define circumstances of movement of the device, wherein the matrix includes a plurality of matrix-entries, and wherein each matrix-entry includes a distance covered by the device during the time period under predefined circumstances of movement; and transmitting the summarized data from the device to the server.

28 Claims, 14 Drawing Sheets

U.S. PATENT DOCUMENTS

| | | | | |
|---|---|---|---|---|
| 2008/0013790 | A1* | 1/2008 | Ihara et al. | 382/104 |
| 2008/0252485 | A1* | 10/2008 | Lagassey | 340/907 |
| 2012/0246733 | A1* | 9/2012 | Schafer et al. | 726/26 |

FOREIGN PATENT DOCUMENTS

| | | | |
|---|---|---|---|
| EP | 1 918 895 | A2 | 5/2008 |
| EP | 1 921 580 | | 5/2008 |
| EP | 2 009 610 | A2 | 12/2008 |
| FR | 2 866 727 | A1 | 8/2005 |
| FR | 2 900 728 | A1 | 11/2007 |
| WO | WO 2008/124805 | | 10/2008 |
| WO | WO 2008/134888 | | 11/2008 |
| WO | WO 2008/141456 | | 11/2008 |

OTHER PUBLICATIONS

International Search Report from corresponding PCT/EP2010/004838 dated Dec. 14, 2010, (10 pages).

Extended European Search Report from corresponding European Application No. 09 01 1182.4, dated Mar. 10, 2010, 4 pages.

Troncoso et al., "PriPAYD: Privacy Friendly Pay-As-You-Drive Insurance," WPES '07, Oct. 29, 2007 (9 pages).

Schaub et al., "Privacy Requirements in Vehicular Communication Systems," 2009 International Conference on Computational Science and Engineering, 2009 IEEE, pp. 139-145.

"Usage based Insurance" Wikipedia, the free encyclopedia, http://en.wikipedia.org/wiki/PAYD, Jun. 16, 2009 (6 pages).

"Driving Telematics Telematics Solutions at a Glance—An insight into PTV Software and Map Technology," PTV Mobility Logicts, date unknown (8 pages).

Gaehler, Ruedi, "Telematics Developments in the Sector of MTPL and Future-Oriented Solutions," PartnerRe, Oct. 7, 2008, (PowerPoint presentation) (46 slides).

Langevoort, Harry, "Tracking and Tracing in a complex environment," Inspiration for Innovators, IBM Corporation, Sep. 11, 2007 (PowerPoint presentation) (34 slides).

* cited by examiner

COMPUTER-IMPLEMENTED METHOD FOR ENSURING THE PRIVACY OF A USER, COMPUTER PROGRAM PRODUCT, DEVICE

BACKGROUND OF THE INVENTION

1. Priority Claim

This application claims the benefit of priority from European Patent Application No. 09 011 182.4-1245, filed Aug. 31, 2009, which is incorporated by reference.

2. Technical Field

This application relates to a computer-implemented method for ensuring the privacy of a user, a computer program product, and a device.

SUMMARY

According to an aspect, a computer-implemented method for ensuring the privacy of a user and the utility of data communicated by a device, such as a vehicle telematics device, to a server. The method may comprise receiving data at the device during a time period; processing, by the device, the received data; summarizing, by the device, the processed data in a matrix, wherein the rows and columns of the matrix define circumstances of movement of the device, wherein the matrix includes a plurality of matrix-entries, and wherein each matrix-entry includes a distance covered by the device during a time period under a pair of circumstances of movement; and transmitting the summarized data from the device to the server.

Summarizing the data in the matrix as described above may have the effect of ensuring the privacy of the user and the utility of the data communicated by the device. This is because the summarization reduces the processed data to the distance covered and the circumstances of movement under which the distance was covered. Thus, the transmitted data may not include sensitive user data, thereby ensuring the user's privacy. However, since the transmitted data includes the distance covered and the circumstances of movement, the transmitted data retains utility.

It may be understood that summarizing the data may refer to compressing and aggregating (e.g. statistically aggregating) the data. In particular, summarizing may refer to converting a distance covered at a specific velocity to distance covered at a range of velocities.

The processed data may include at least one of position data, velocity data, and time data. In addition, the velocity data may indicate a speed at which the device has been moved. The term "velocity" may refer to a vector having a direction and a value. The term "speed" may refer to the value of the velocity.

The method may further comprise correlating the position data and/or the velocity data and/or the time data with map information stored on the device; determining, by the device and based on the correlation, that the user has performed an action with an associated consequence; and generating, in particular communicating, by the device, an alert in response to the action.

The alert may be understood as a simple way of interacting with the user without distracting the user. The alert may be communicated and may include a visual display and/or audio sound in such a way that substantially no distracting signals are provided that do not relate to the alert. The alert may provide information that is otherwise not available to the user of the device such as a driver of a vehicle. Thus, the alert may be a simple way to inform the user of the action. This simplification may also reduce costs, e.g. the cost of displaying a map. Furthermore, in view of the alert, the user may be able to take corrective action to improve his driving (e.g. respond to alerts, avoid future alerts, etc.).

The method may also comprise encrypting, before transmission, the summarized data, wherein the summarized data can be decrypted by the server without assistance from the user. In addition, the method may comprise encrypting, before the transmission, the processed data corresponding to the action, wherein the processed data can only be decrypted with a key of the user. Furthermore, the method may comprise transmitting the encrypted processed data from the device to the server.

The two different types of encryption may have the effect of improving the security of the processed data. Thus, the processed data may be stored on the server while still ensuring the privacy of the user, since this data can only be accessed with the consent of the user (e.g. by means of a secret key of the user). By encrypting the summarized data in a way that it can be decrypted without the assistance of the user, the summarized data may be protected from third parties. Furthermore, the summarized data can be used and processed at the server.

Moreover, by only encrypting and transmitting the processed data to the server in response to the action of the user, CPU load on the device is conserved and network traffic is reduced. Nevertheless, there is sufficient data (the encrypted processed data) stored at the server to fully document the action of the user that generated the alert.

In some specific embodiments, the summarized data may be encrypted using a public key of the server or a secret key shared between the user and the server. Some embodiments may specify that the processed data is encrypted with a secret key of the user or a public key of the user. In addition, some specific embodiments may specify the simultaneous transmission of encrypted processed data and encrypted summarized data.

It may be that the predefined circumstances of movement include one or more of the following a velocity range at which the device covered the distance; a rate of acceleration at which the device covered the distance; a speed limit corresponding to at least one position within the distance covered by the device; or a road category corresponding to at least one position covered by the device.

The rate of acceleration may be determined using a sensor, or acceleration may be calculated based on a change in velocity over a period of time. In other words, the acceleration may be determined empirically using a sensor and/or may be determined mathematically as the first order time derivative of the velocity and/or the second order time derivative of the position, wherein velocity and/or position may be obtained empirically e.g. using a GPS sensor.

Accordingly, the map information may comprise a set of map coordinates. It may be that correlating the position data and the velocity data further comprises correlating the position data and the velocity data with a road category and/or a speed limit linked to the set of map coordinates.

Furthermore, the action may include one or more of the following: exceeding a speed limit; exceeding a predefined rate of acceleration; approaching and or being at a position that presents a risk to the user.

Moreover, it may be that the device does not display the map information. Consequently, the alert may be communicated and may include a visual display and/or audio sound in such a way that substantially no distracting signals are provided that do not relate to the alert. Thus, the alert may be a simple way to inform the user of the action. This simplification may also reduce costs, e.g. the cost of displaying a map on the device, or providing a sophisticated display.

Also, it may be that at least one matrix entry $E_{ij}$ is composed of a plurality of elements, wherein each element $e_{ij}^{k}$ of the plurality of elements defines a distance. Furthermore, the distance defined by the element $e_{ij}^{k}$ may have been covered during a time interval which is nonadjacent to the time interval during which the distance defined by the next element $e_{ij}^{k+1}$ was covered. In addition, it may be that the plurality of elements of each matrix entry defines the distance covered by the device during the time period under the pair of predefined circumstances of movement corresponding to said matrix entry, and it may be that the plurality of matrix entries defines the distance covered by the device during the time period.

In the text above, $$E_{ij} = \sum_{k=1}^{N} e_{ij}^{k},$$

where N is a natural number. In some cases, it may be that N is less than 20.

In some embodiments, the matrix may have a maximum size of 30×30. In other words, values of i and j may be in the range of 0 to a maximum value of 29. It is also possible that the maximum value is less than 29. In a preferred embodiment, a size of the matrix may be 26×26. In other words, values of i and j may be in the range of 0 to 30, preferably 10 to 30 more preferably 20 to 30. In some cases the matrix may not be square (e.g. an ecological matrix).

In some implementations, a smallest size of an element $e_{ij}^{k}$ may be 10 meters. Other implementations, e.g. the smallest size of 20 m, 50 m or 1 km, are also possible. In some cases, a matrix entry may be 0. Also, a matrix entry may be composed of only one element.

Accordingly, the device may be embedded in a vehicle. Also, the method may comprise compensating the user because the device is embedded in the vehicle.

Additionally, the matrix may be used to calculate an indication of driving behavior.

In some embodiments, the method may comprise: aggregating the transmitted data with data from at least one other device at the server, and generating statistical data based on the aggregated data at the server, as well as providing a web portal, wherein the user is able to access the statistical data and/or the summarized data of the user by means of the web portal.

It may be that the web portal comprises two web portals, where a first web portal is designed to be accessed from a personal computer and a second web portal is designed to be accessed from the telematics device. It may be desirable to have two web portals in order to account for limited capabilities of the telematics device. It may be that the web portal is a dynamic web portal, which may include that the device accessing the web portal may be deduced and the information/data provided by the web portal may be adapted to the device. Hence, a user accessing the web portal using a mobile device, such as a PDA, may receive different data compared to when accessing the web portal using a network computer. Accordingly, the network is used in an optimum manner regarding the device trying to access the portal.

The display of summarized and aggregated data at the portal may result in an improved man-machine interaction. Since the user is provided with online feedback related to his driving behavior and/or fuel consumption, the user may be able to take corrective action to improve his driving (e.g. avoid risks, reduce fuel consumption, etc.).

According to another aspect, a computer program product is provided. The computer program product may comprise computer-readable instructions which may be stored on a computer-readable medium or provided as a data signal, such that when the instructions are loaded and executed on a device having a memory and processor, such as a vehicle telematics device, the instructions cause the device to perform operations according to the method aspect described above.

According to yet another aspect, a device, such as a vehicle telematics device is provided. The device may comprise: a receiver operable to receive data during a time period, wherein the received data indicates that the device has been moved during the time period; a processor operable to process the received data, and summarize the processed data in a matrix, wherein the rows and columns of the matrix define circumstances of movement of the device, wherein the matrix includes a plurality matrix-entries, and wherein each matrix-entry includes a distance covered by the device during the time period under a pair of said predefined circumstances of movement; and a transmitter operable to transmit the summarized data to the server.

In some embodiments, the device is a mobile device, such as a mobile telephone. It may be that the device is physically embedded in a vehicle, and wherein the device uses an interface of the vehicle to communicate.

In accordance with the methods, systems, program, and devices described herein, manufacturing/installation costs and also the technical complexity of the device may be reduced by avoiding duplication of vehicle components in the device.

As used herein, a "telematics device" may be understood as a telecommunication device capable of sending, receiving and storing information. Similarly, a "vehicle telematics device" may be understood as a telematics device used within a road vehicle. The telematics device may be connected to and/or include a GPS module. The telematics device may be a smartphone, PDA, netbook, or other electronic device that can be used within or embedded in a vehicle.

A "user" may be a person or an individual. According to a specific example, the user is a driver of a vehicle, e.g. a car.

A "secret key" of a user may be understood as a key used in symmetric encryption and decryption that is known only to the user.

A "private key" of a user may be understood as an asymmetric cryptographic value known only to the user. The private key may be used as part of a public-private key pair or for digital authentication (e.g. digital signing of a message).

Ensuring the "privacy" of a user may be understood to include protecting the data of the user, in particular, protecting sensitive data of the user. Sensitive data may include the following: position data, time data, and the identity of the user; sensitive data may further include a combination of one or more of these data elements.

Ensuring the "utility" of data communicated by a device may be understood to include providing data that is useful to a receiver of the communicated data.

"Summarizing" processed data may be understood as reducing the processed data in a way that relevant data is retained and sensitive data is eliminated. Summarizing data may have the effect of eliminating sensitive data while retaining useful data. Summarizing data may be understood as a form of processing data. Thus, summarizing the processed data may be understood as a way of processing the processed data. Moreover, summarizing may be understood as creating matrix entries from the data.

"Moving the device" may be performed by the user. For example, the device may be in a vehicle driven by the user from one location to another location. In addition, the time period during which the device is moved may be predefined. In other words, the duration of the time period may be defined before the device is moved. It is possible that the duration of time is included in the programming of the device before the user has access to the device. It is also possible that the time period is defined by the configuration of the device.

The "circumstances of movement" may be predefined. In other words, the circumstances of movement may be defined before the device is moved. It is possible that the circumstances of movement are included in the programming of the device before the user has access to the device. It is also possible that the circumstances of movement is defined by the configuration of the device.

A "pair of circumstances of movement" may be understood as two circumstances of movement, one corresponding to the row of a matrix entry and the other corresponding to a column of the matrix entry.

It will also be appreciated that the "distance" included in a matrix entry is 0.

"Time data" may be understood as a timestamp, e.g. year, month, day, hour, minutes, seconds.

A "consequence" associated with an action may be a potential consequence such as a potential legal fine, possibly associated with a speeding violation. Additionally or alternatively, a consequence may be an increase in a fee charged by a service provider (e.g. insurance company) to a user.

A "position" may be understood as a point or a particular place. Position may be represented in three dimensions, i.e. length, width, height.

The subject matter described in this specification, such as the device, can be implemented as a method or on a device, possibly in the form of one or more computer program products. The subject matter described in the specification can be implemented in a data signal or on a machine or computer readable medium, where the medium is embodied in one or more information carriers, such as a CD-ROM, a DVD-ROM, a semiconductor memory, or a hard disk. Such computer program products may cause a data processing apparatus to perform one or more operations described in the specification.

In addition, subject matter described in the specification can also be implemented as a system, such as a computer system, including a processor, and a memory coupled to the processor. The memory may store or encode one or more programs for execution by the processor to cause the processor to perform one or more of the methods described in the specification, including, as examples, the state transitions, logic, and other processes described in connection with FIGS. 5 and 6, tables 2, 3, and 4, or any other part of the specification and drawings. Further subject matter described in the specification can be implemented using various machines, devices, and computer-implemented systems. The subject matter may be selectively implemented across multiple computer or processing systems, including telematics devices, Service Delivery Platforms, service providers, or other systems.

Other systems, methods, features and advantages will be, or will become, apparent to one with skill in the art upon examination of the following figures and detailed description. All such additional systems, methods, features and advantages are included within this description, are within the scope of the invention, and are protected by the following claims.

BRIEF DESCRIPTION OF THE DRAWINGS

The system may be better understood with reference to the following drawings and description. The elements in the figures are not necessarily to scale, emphasis instead being placed upon illustrating the principles of the type model. In the figures, like-referenced numerals designate corresponding features throughout the different views.

DETAILED DESCRIPTION OF THE PREFERRED EMBODIMENTS

A detailed description of examples is provided herein with reference to the drawings. It should be understood that various modifications to the examples may be made. In particular, elements of one example may be combined and used in other examples to form new examples.

Figure 1:
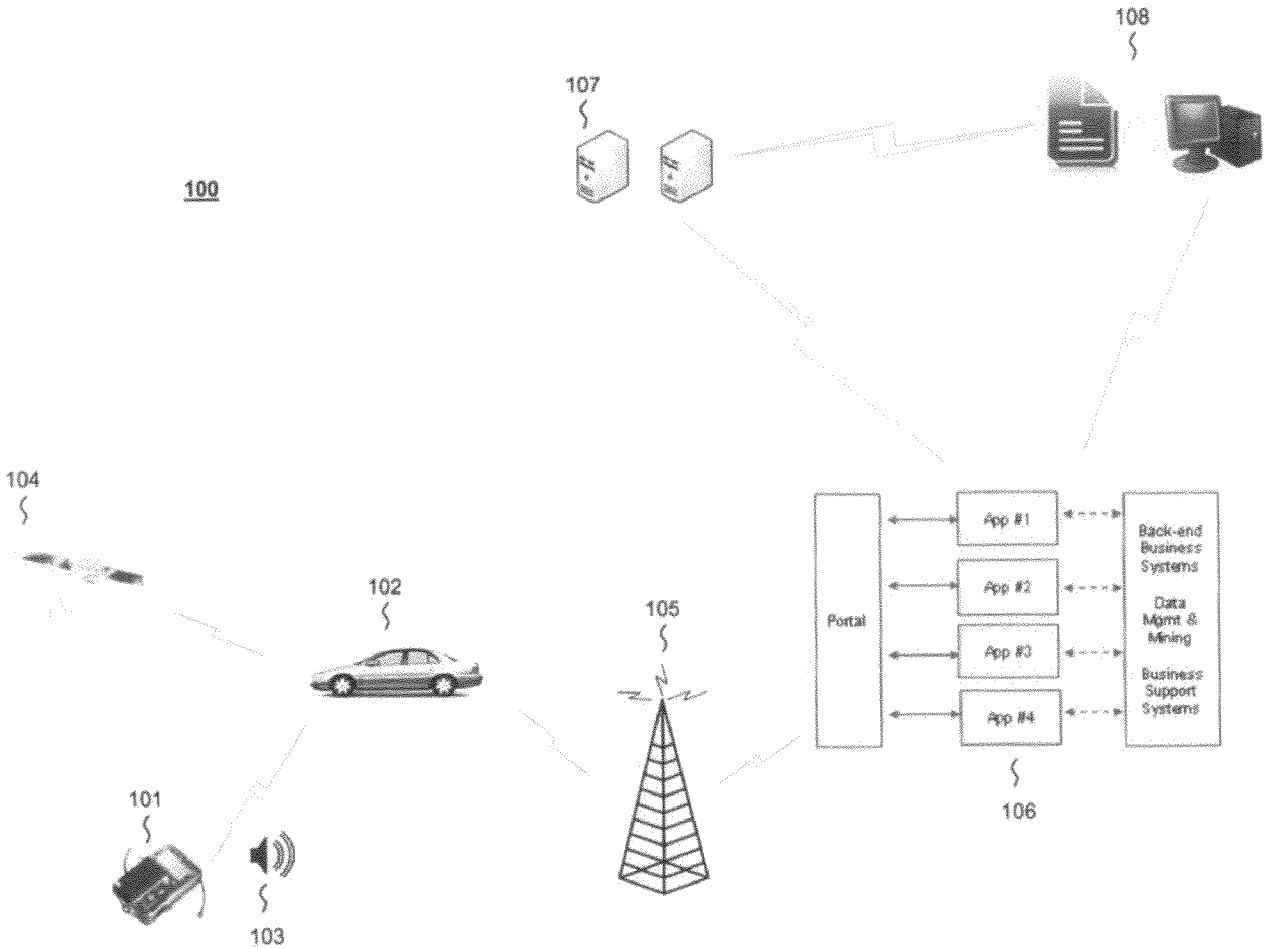
FIG. 1 depicts an exemplary telematics system.

FIG. 1 depicts an exemplary telematics system 100. A telematics device 101 may be located in a vehicle 102. The vehicle 102 may be a car or truck capable of carrying passengers and capable of being driven on a road. The telematics device 101 may be equipped with sensors and may be capable of providing an audio feedback 103. In addition, the telematics device 101 may be equipped to receive signals from a satellite 104. The satellite 104 may be a global navigation satellite system, e.g. the global positioning system (GPS). The satellite 104 may be capable of sending radiowave signals that allow the telematics device to determine its current location, the current time, and the velocity of the vehicle 102. The telematics device 101 may summarize (or aggregate) the data received from the satellite 104 before sending the data by means of a telecommunications service provider 105 to a service delivery platform (SDP) 106.

The service delivery platform 106 may aggregate data from several other telematics devices toward submitting the data to a service provider 107. The service provider 107 may be an automotive service provider, or more specifically, an insurance company. Data transmitted by the telematics device 101 and the SDP 106 may be encrypted. The data transmitted from the telematics device 101 to the SDP 106 may include an identifier of the telematics device 101. It may be that the SDP 106 does not have the data to allow it to match the identifier of the telematics device 101 with the driver of the vehicle 102. The user 108 may receive services from the service provider 107. The user 108 may also be understood as the customer of service provider 107. The cost of the services received by the user 108 may be based on the data sent from the telematics device 101. The user 108 may be the driver of the vehicle 102.

The telematics device 101 may be a mobile phone such as an Apple iPhone (Apple and iPhone are trademarks of Apple Corporation), a Personal Digital Assistant (PDA), a netbook, etc. The telematics device 101 may include an operating system (OS) such as Windows Mobile (for example; Windows Mobile 6.X), Blackberry OS, iPhone OS, Symbian OS, etc. In addition or alternatively, the telematics device 101 may be embedded in the vehicle 102. In other words, the telematics device 101 may be physically integrated within the vehicle 102, such that the telematics device 101 cannot easily be taken out of the vehicle 102. The user 108 may be compensated because the telematics device 101 is embedded in the vehicle 102. More specifically, the user 108 may receive a deduction in fees (e.g. insurance premiums) the user 108 pays to the service provider 107 because the telematics device 101 is embedded in the vehicle 102. Embedding the telematics device 101 in the vehicle 102 may have the effect of preventing the user 108 from driving the vehicle 102 without the telematics device 101. The embedded telematics device 101 may use an interface of the vehicle 102 to communicate alerts generated in response to an action of the user 108.

The telematics device 101 may provide a Graphical User Interface (GUI). The GUI of the telematics device 101 may be capable of displaying GUI elements. For example, the GUI of telematics device 101 may be capable of displaying one or more of the following: a velocity of the vehicle 102, an allowed maximum velocity corresponding to a location of the vehicle 102, a status of a signal from the satellite 104, a settings input element (e.g. a settings button), and an error control input element (e.g. an error control button). The GUI of the telematics device 101 may also be capable of receiving input. For example, the GUI of the telematics device 101 may be used to modify a tolerance value (e.g. time or speed) for violations. Also or alternatively, the GUI of the telematics device 101 may be used to designate an incorrect violation, i.e. a violation that was mistakenly recorded. According to a specific example, the GUI of the telematics device 101 has a resolution of 800×480 pixels. The telematics device 101 may include a driving analysis application.

Figure 2:
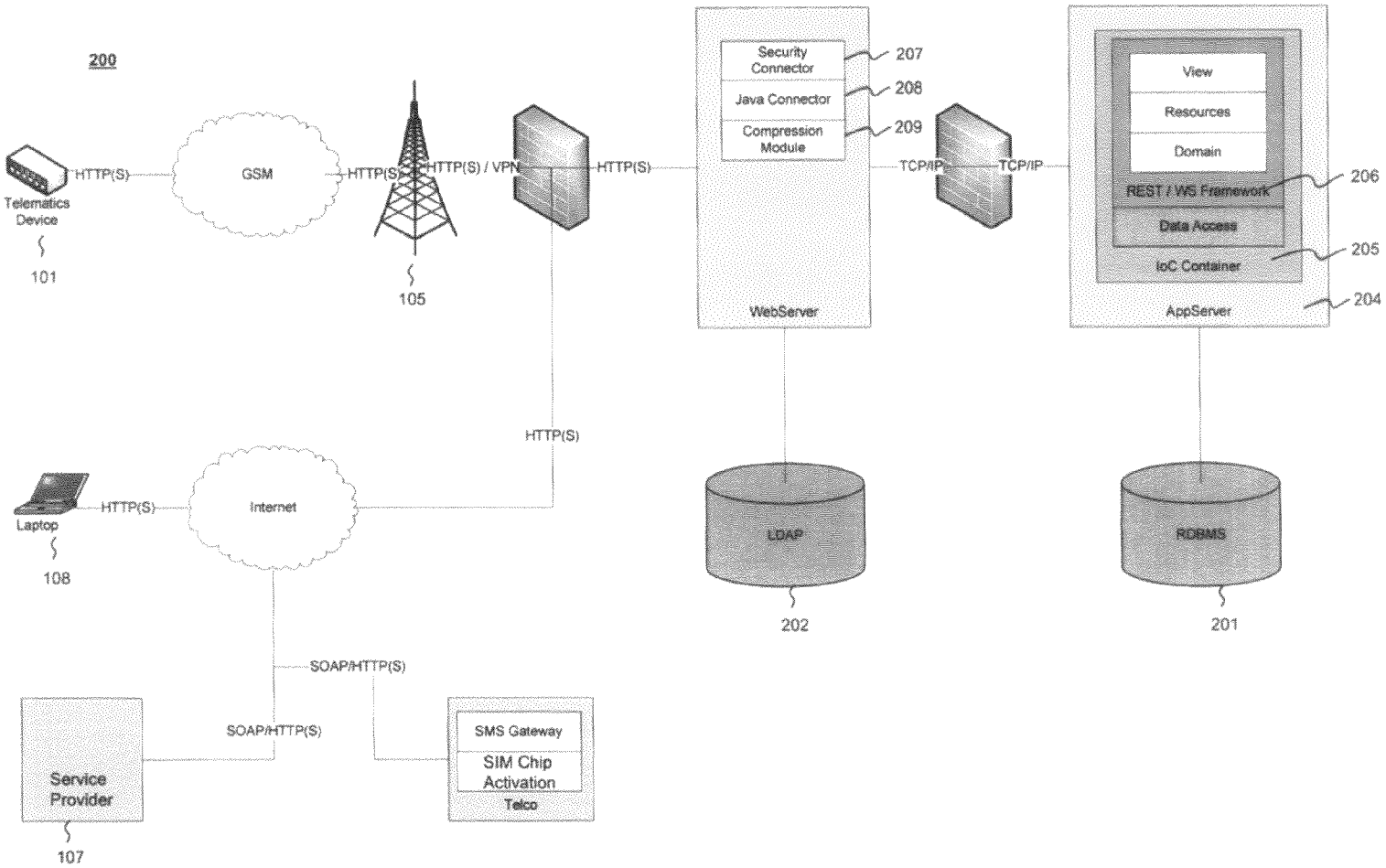
FIG. 2 depicts an exemplary logical architecture of the telematics system.

FIG. 2 depicts an exemplary logical architecture 200 of the telematics system 100. Even though the description of FIG. 2 refers to specific software components, other implementations (e.g. other components or combinations of components) are also possible. The telematics device 101 may communicate with the telecommunication service provider 105 by means of the general packet radio service (GPRS), available to users of the global system for mobile communications (GSM). Alternatives to GPRS and GSM, such as the universal mobile telecommunication system (UMTS), a wireless network protocol, etc., are also possible. As an example, any communications system capable of supporting transmissions of approximately 20 kb per day from a mobile device could be used.

The architecture depicted in FIG. 2 may be understood as a Java multi-tier web architecture with a database 201, e.g. a relational database management system (RDBMS), as a back end (Java is a trademark of Sun Microsystems, Inc.).

The architecture may be implemented according to a model view controller design pattern, where the view is realised through hypertext mark up language (HTML), cascading style sheets (CSS), and Java server pages (JSP). The domain model of the logical architecture 200 may be implemented with plain old Java objects (POJO). A POJO may be understood as an object that does not include features from a complicated object framework, but instead only includes the necessary features to accomplish the purpose for which it is intended. The POJOs of the domain model may be persisted in the database 201. In order to provide a simplified access model, in particular to connect the telematics device 101, a representation state transfer (REST) framework 206 may be used. Software components on the application server 202 may be plugged into the framework of an inversion of control (IOC) container 205.

The telematics device 101 may transmit data by means of GPRS through a mobile phone network of the telecommunications service provider 105. Data may be transmitted by means of a virtual private network using hypertext transfer protocol (HTTP) requests. An example of an HTTP request and reply can be found in table 1 below.

TABLE 1

```
> PUT /PAYDApplication/app/payd/MyInsurance/devices/4711/tracks/2009-01-
19%2021:52:30 HTTP/1.1
> User-Agent: curl/7.19.2 (i386-pc-win32) libcurl/7.19.2 OpenSSL/0.9.8i zlib/1.2.3 libidn/1.11
libssh2/0.18
> Host: localhost:8080
> Accept: */*
> Content-Length: 511
> Expect: 100-continue
>
< HTTP/1.1 100 Continue
< HTTP/1.1 201 Created
< Server: Apache-Coyote/1.1
< Location: http://localhost:8080/PAYDApplication/app/payd/MyInsurance/devices/4
711/tracks/2009-01-19%2021:52:30
< Content-Type: application/xml
< Content-Length: 0
< Date: Thu, 29 Jan 2009 11:07:38 GMT
<
* Connection #0 to host localhost left intact
* Closing connection #0
```

Lines of the request are preceded by “>” symbols, while lines of the reply are preceded by “<” symbols. HTTP status codes may be used to confirm receipt of a message. Similarly, HTTP error codes may be used to indicate that a problem has occurred.

According to a specific example, particular software components may be used to implement parts of the logical architecture 200. Thus, the database 201 may be implemented using MySQL software (MySQL is a trademark of Sun Microsystems Inc.). Furthermore, the lightweight directory access protocol (LDAP) server 202 may be implemented using open OpenLDAP. The web server 203 may be implemented using Apache software, and the application server 204 may be implemented using Tomcat software. The IOC container 205 may be implemented using Spring software, a REST framework 206 may be implemented using the Java API for RESTful Web Services (Jersey), and a web service framework 206 may be implemented using Spring-WS. A security connector 207 may be implemented using mod_ssl (i.e. the Apache web server module for secure sockets layer), a Java connector 208 may be implemented using mod_jk, and a compression module 209 may be implemented using mod_gzip or mod_deflate.

Figure 3:
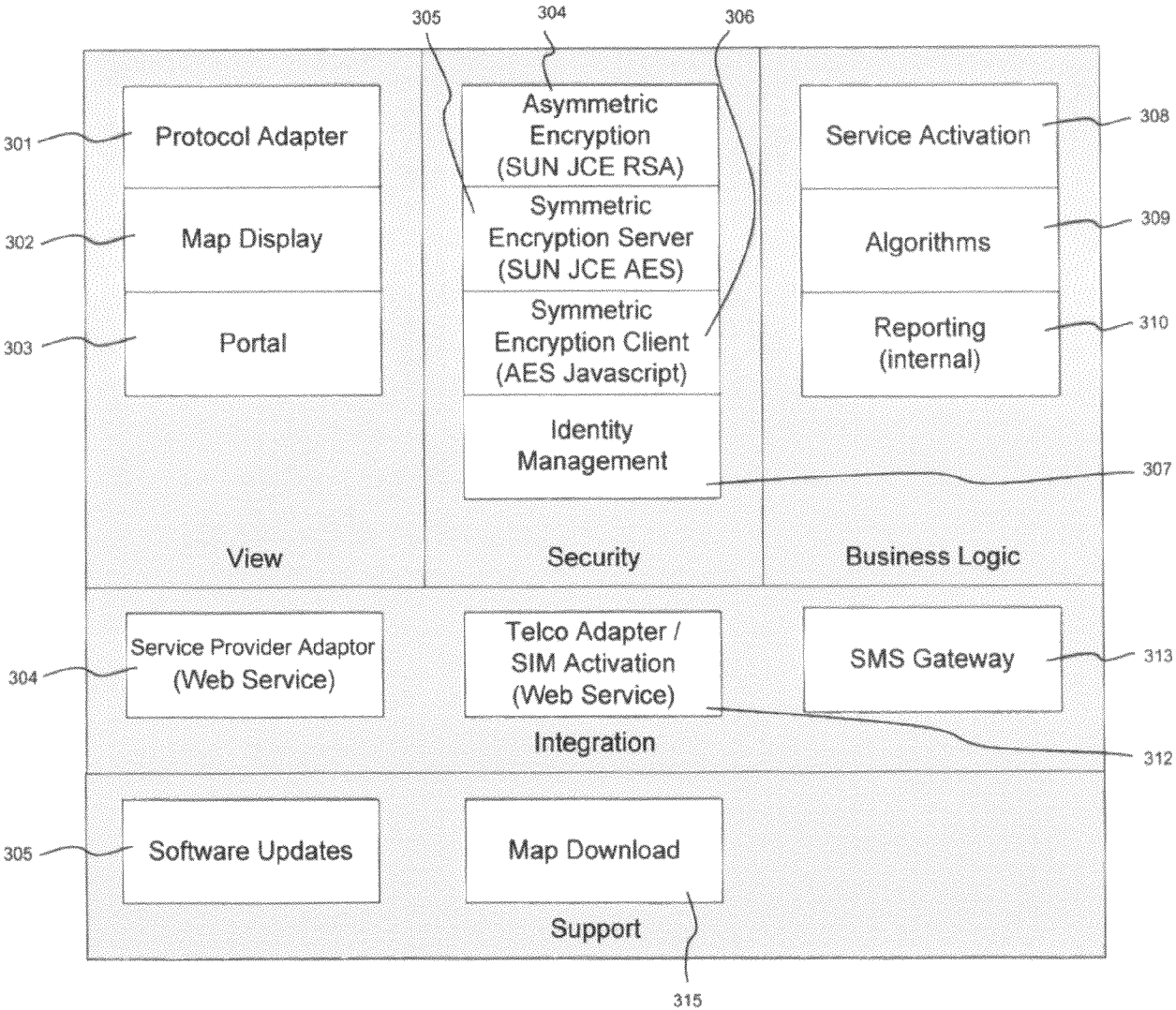
FIG. 3 depicts an exemplary functional architecture of the telematics system.

FIG. 3 depicts a functional architecture 300 of the telematics system 100. A protocol adapter 301 may perform a translation of wire protocols. For example, if messages are transmitted using extensible mark up language (XML) or Jason (a Java based, agent-oriented interpreter), the Java architecture for XML binding (JAXB) may be used for translation. JAXB can be used to map XML elements to classes in the Java programming language. If abstract syntax notation 1 (ASN.1) is implemented, a commercial ASN.1 compiler may be used to perform translation. A map display 302 may be, used to display tracks or location dependent information on a map. A track may be understood as an ordered collection of points that provide a record of where a driver has been. The points in a track may comprise position data received from the telematics device 101. According to one example, Javascript may be used to format GPS exchange format (GPX) data for display using the Google maps Application Programming Interface (Google is a trademark of Google Corporation). A portal 303 may be provided for a user interaction and may be implemented using a Spring mode view controller to provide web flow and personalisations.

Asymmetric encryption 304 with a public key and a private key may be used to encrypt data traffic between telematics device 101 and SDP 106. A symmetric encryption server 305 may be used to encrypt and decrypt, the private asymmetric key at the SDP 106. A symmetric encryption client 306 may be used to encrypt and decrypt the private asymmetric key, e.g. in a web browser. Asymmetric encryption may be implemented using the Rivest Shamir Adleman (RSA) algorithm and symmetric encryption may be implemented using the advanced encryption standard (AES). In some embodiments, the symmetric encryption client 306 may implement encryption/decryption in Javascript using a Javascript Crypto Library (AGPL) or gibberish-aes (MIT). Identity management 307 may be performed using LDAP to import and store certificates.

Service activation 308 may be performed using a dedicated activation resource. Algorithms 309 may be used to encapsulate analysis of driving behaviour. Reporting may be implemented using SQL scripts to analyse data collected from telematics device 101, and possibly other telematics devices as well. Service provider adapter 311 may be implemented as a web service that provides access to SDP 106 for service providers, such as service provider 107. Service provider adapters 311 may be used to process data from new service providers and to deliver analysis of individual and statistically aggregated driver behaviour to the appropriate service provider.

A telecommunication's adapter 312 may be used to activate a subscriber identity modular (SIM) card used with telematics device 101. The telecommunications adapter 312 may be implemented using a web service. An SMS gateway 313 may be used for the sending of short message service (SMS) messages, in particular, binary SMS messages. The SMS gateway 313 may be implemented using a web service. Software updates application 314 may be used for the transfer of software updates to telematics device 101. According to one specific example, a REST get command may be used to initiate data transfer, and a message from SMS gateway 313 may be used to trigger a data upload by telematics device 101. A map download application 315 may be used to transfer map updates to telematics device 101. According to one example a REST get command may be used for data transfer, and an SMS message may trigger a map upload.

Figure 4:
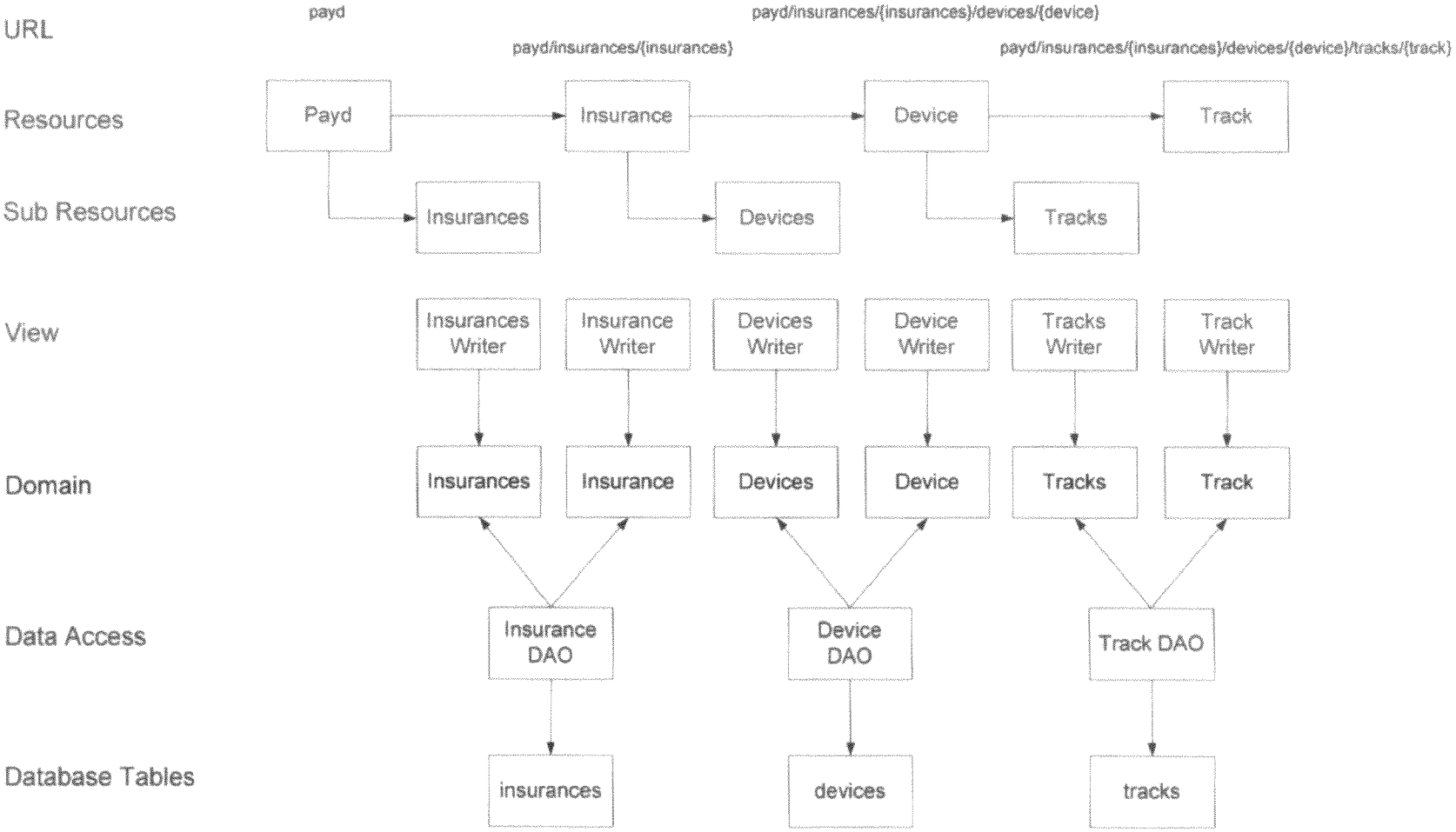
FIG. 4 shows an exemplary software architecture of the telematics system.

FIG. 4 specifies details regarding software layers on the application server and a URL structure for messages sent by telematics device 101.

Figure 5:
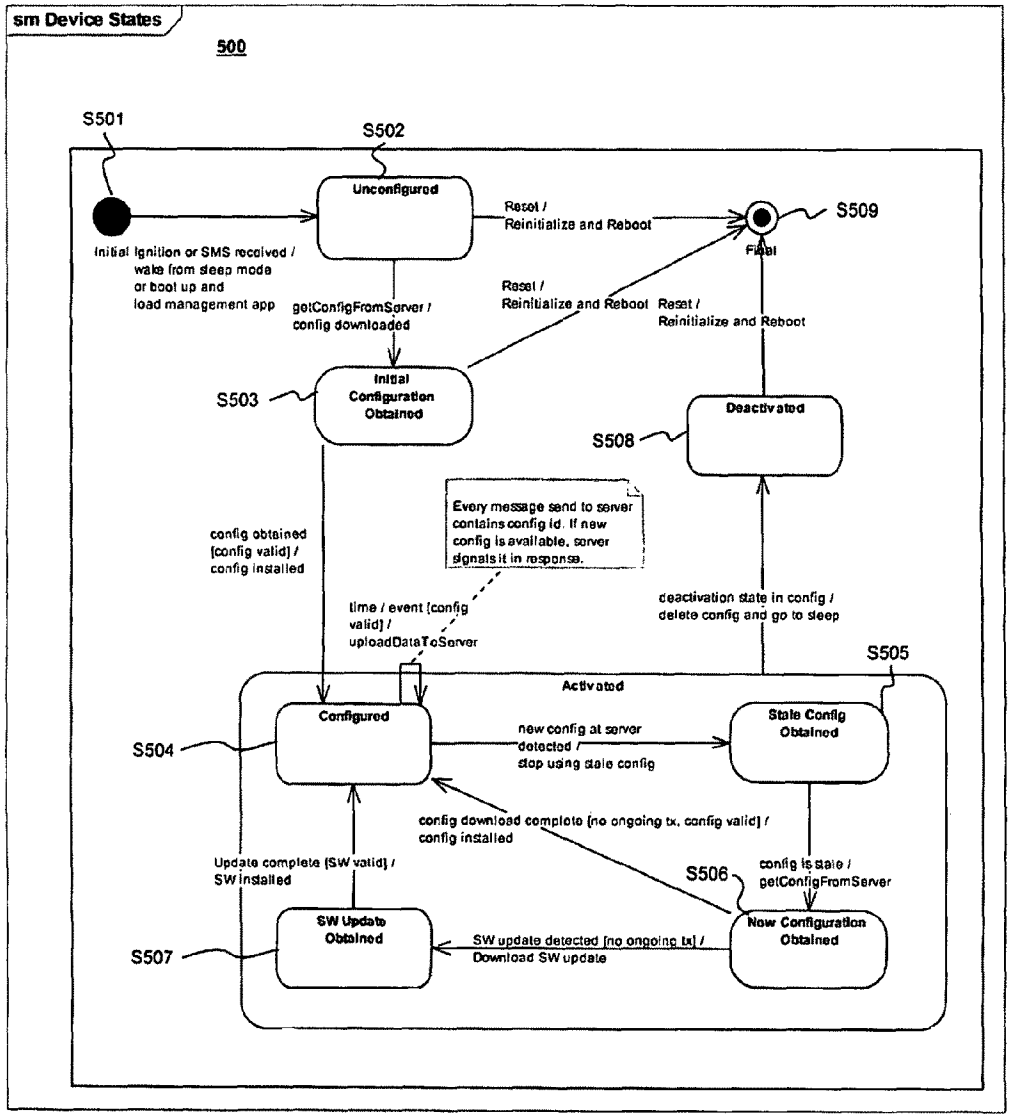
FIG. 5 shows possible states and state transitions of the telematics device.
Figure 6:
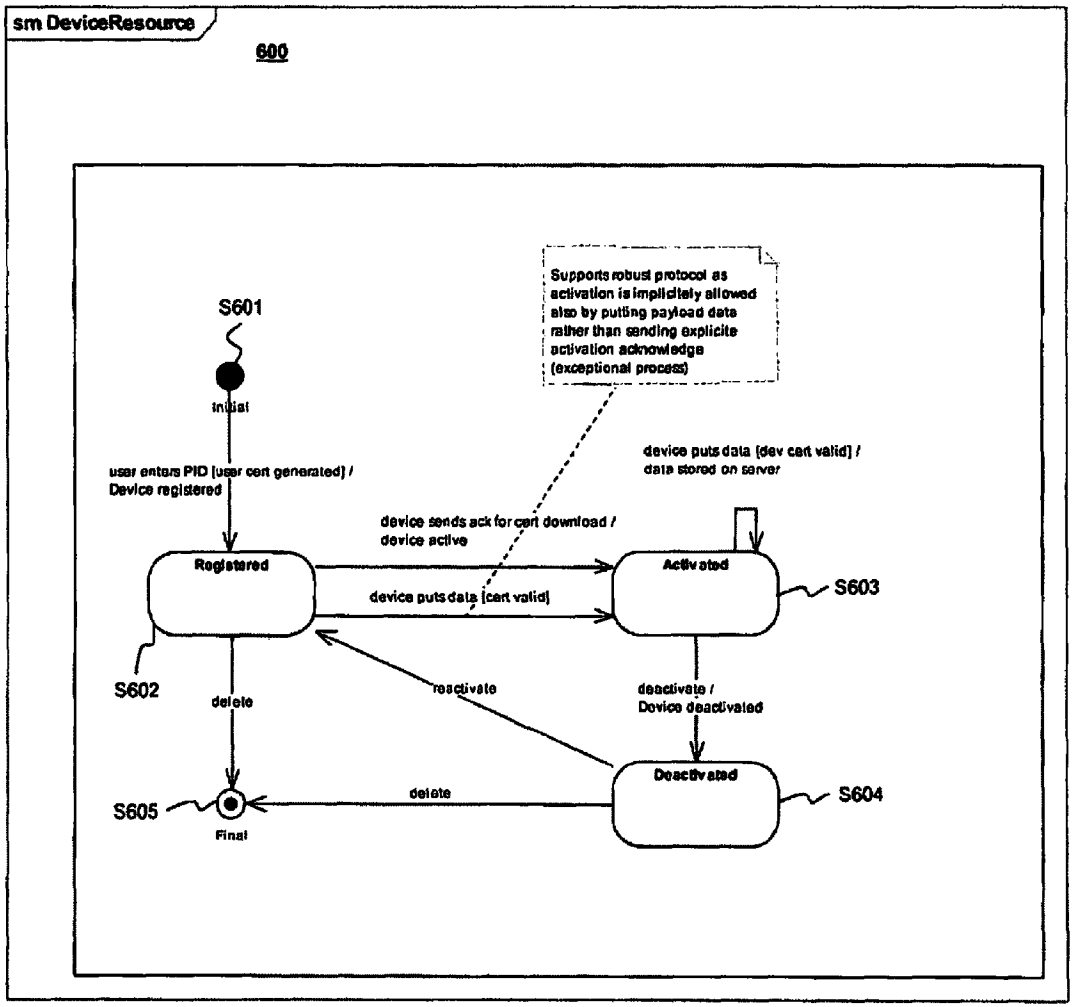
FIG. 6 shows possible states and state transitions of a Service Delivery Platform.

FIGS. 5 and 6 specify the states and state transitions of the telematics device 101 and the SDP 106.

FIG. 5 shows possible states and state transitions of the telematics device 101. In particular, device transition diagram 500 may be understood to show the steps involved in order to effect a software or configuration update on telematics device 101. The process begins at step S501 with either initial ignition of the vehicle 102, or receipt of an SMS message at the telematics device 101. Initial ignition or receipt of the SMS message may cause the telematics device 101 to wake up from sleep mode, or to boot up and load a management application. At step S502 the telematics device 101 does not have an available configuration to load. This may be addressed by downloading a configuration from the SDP 106 at step S503. After the configuration is obtained from the SDP 106, the configuration may be loaded at step S504. Every message sent from the telematics device 101 to the SDP 106 may contain a configuration identifier. The SDP 106 may indicate that a new configuration is available when confirming receipt of an event message from the telematics device 101.

At step S505, the telematics device 101 receives a message from the SDP 106 indicating that a new configuration is available. The telematics device 101 may download the new configuration from the SDP 106 at step S506. Optionally, an additional software update may be downloaded at step S507. Once the new configuration has been installed, possibly along with additional software, the telematics device 101 returns to S504. It may be that the telematics device 101 is shut down or deactivated at step S508. The telematics device 101 may, delete its current configuration before shutting down. After deactivation, the telematics device 101 may receive an instruction to reset at step S509. The instruction to reset at step S509 may be given in various circumstances, possibly in order to resolve a problem and return the device to a default or standard configuration.

FIG. 6 shows possible states and state transitions of the SDP 106. In particular, server transition diagram 600 may be understood to show the steps involved in activation and deactivation of the telematics device 101. The process may begin at step S601 when a user enters an identifier in order to generate a user certificate. The telematics device 101 is registered at S602. After verifying that the user's certificate is valid, the device can be activated at S603. Upon receipt of an indication or instruction, the telematics device 101 can be deactivated at step S604. Reactivating device may be achieved by sending the user certificate along with event data. The telematics device 101 may be deleted from the SDP 106 at S605.

Figure 7:
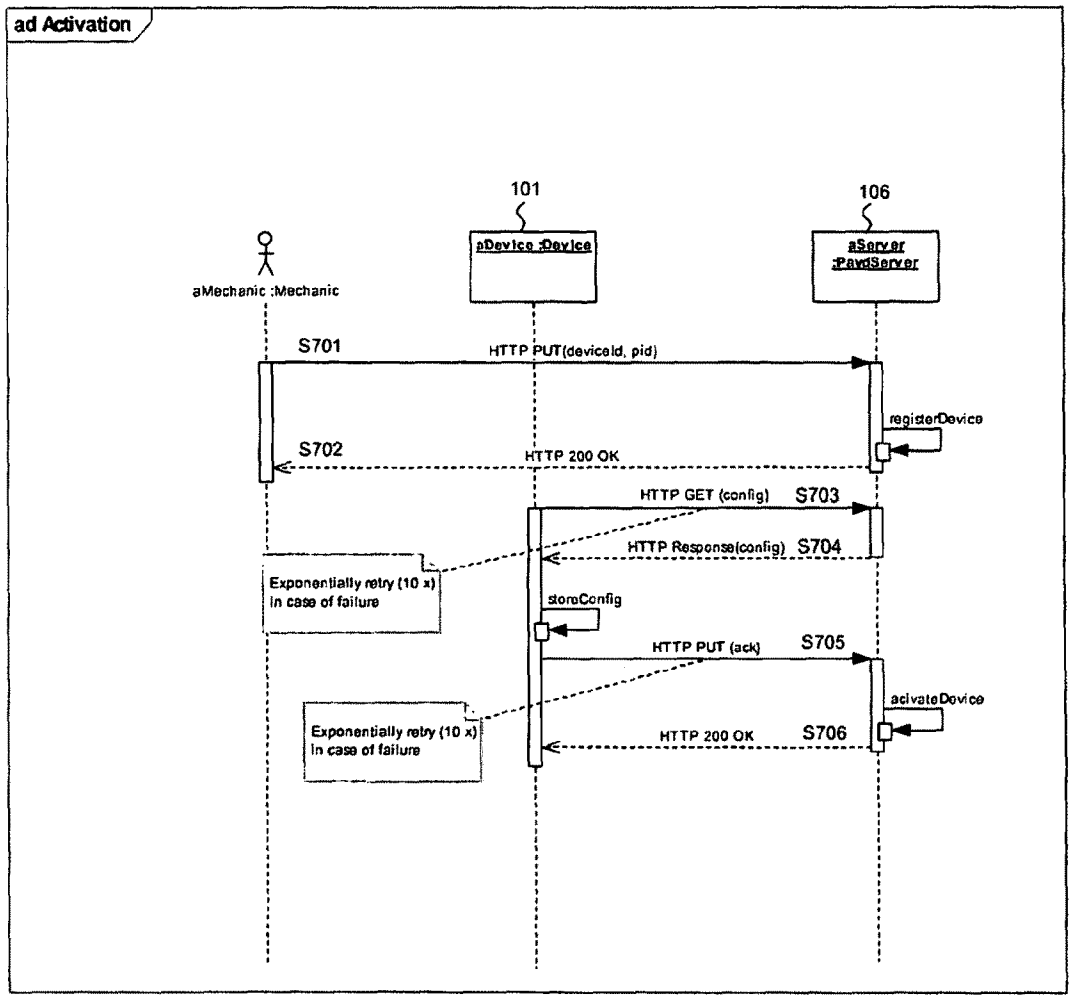
FIG. 7 provides exemplary steps that can be taken in order to activate the telematics device.

FIG. 7 provides an example of how to activate telematics device 101. Activation of the telematics device 101 may be achieved using HTTP with REST semantics. At S701, a user may access the SDP 106. According to a specific example, an HTTP message comprising a PUT command, an identifier of the telematics device 101 (deviceid), and a user identifier (pid) may be sent from the user to the SDP 106. SDP 106 may register the telematics device 101 and then send a confirmation message to the user at S702.

At S703 the telematics device 101 may attempt to download a new configuration from the SDP 106. If the initial configuration request from telematics device 101 fails, new requests may be issued using an exponential backoff. Exponential backoff may be understood as continuing to double the time between retransmissions if an initial or subsequent transmission request fails (W. Richard Stevens, "TCP/IP Illustrated Volume 1", 1994, pg. 299). At S704, the telematics device 101 may receive a configuration from the SDP 106. The telematics device 101 may store the received configuration. At S705, the telematics device 101 may initiate activation with the SDP 106. If a confirmation of the message sent at S705 is not received, the telematics device 101 may retry using exponential backoff. The telematics device 101 may receive confirmation of activation from the SDP 106 at S706.

Figure 8:
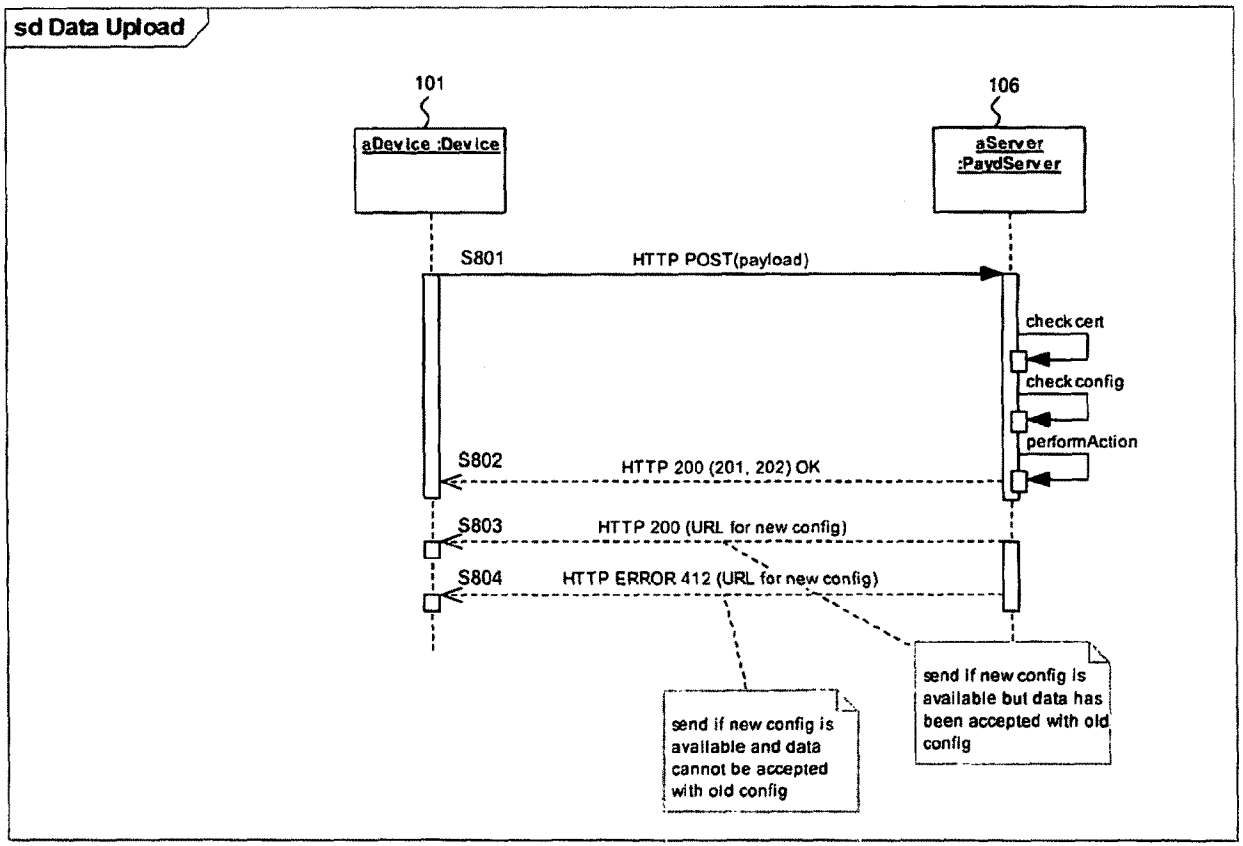
FIG. 8 describes the process of sending an event message from the telematics device to the Service Delivery Platform.

FIG. 8 describes the process of sending an event message from the telematics device 101 to the SDP 106. The telematics device 101 may receive satellite data from the satellite 104. Later, the telematics device 101 may process the received satellite data. Furthermore, the telematics device 101 may summarize the processed data. Summarizing may be a way of further processing the processed data.

At S801 the telematics device 101 may send an event massage to the SDP 106. The event message may include an identifier for the telematics device 101, and the summarized data. The telematics device 101 may summarize the processed satellite data by calculating matrices, and sending a matrix at regular intervals to the SDP 106.

A type of matrix sent from the telematics device 101 to the SDP 106 may be a speed matrix. The speed matrix may reflect the driving behaviour of the user 108 with regard to the driving speed in general and the speed limit in particular. The following notation may be understood to apply to the speed matrix, and, unless superseded, to the ecological driving behaviour matrix and the risk matrix as well.

Let s: $\mathbb{R} \rightarrow \mathbb{R}^3$ with $s(t):=\vec{x}_t$ being a parameterization of the distance covered (i.e. distance traversed). Let v: $\mathbb{R} \rightarrow \mathbb{R}$ with $$v(t) := \frac{d}{dt}|\vec{x}_t| = \frac{d}{dt}x_t$$

being the velocity of the vehicle 102, and $v^m$ being the allowed maximum velocity (i.e. the speed limit). The parameter space of time×location×velocity×speed limit may be defined as $\mathbb{R} \times \mathbb{R}^3 \times \mathbb{R}^2$. Thus, $\phi$: $\mathbb{R} \rightarrow \mathbb{R} \times \mathbb{R}^3 \times \mathbb{R}^2$ with $\phi(t):=(t, \vec{x}_t, v, v^m)$.

The evaluation of the distance covered by the vehicle 102 may be realized using a general weight function $\Omega$ as an integral curve of the distance covered as follows: Let $\Omega(t, \vec{x}_t, v, v^m)$: $\mathbb{R} \times \mathbb{R}^3 \times \mathbb{R}^2 \rightarrow \mathbb{R}^+$ be the weight function, then the following equation may define the velocity measurement of s:

$$\omega(s) := \int_s \Omega \circ \varphi \, ds = \int_t \Omega \circ \varphi |\vec{v}| \, dt \qquad \text{Equation (1)}$$

$\omega$ is a linear function, therefore $\omega$ has the following properties (1 and 2):

$$\omega(s \cup s') = \omega(s) + \omega(s'). \qquad \text{Property (1)}$$

In other words, $\omega$ is linear relative to position components of the distance covered. In addition, $$\omega(s) = 0 \text{ when } l(s) = 0. \qquad \text{Property (2)}$$

In other words, $\omega$ is 0 when the length of the distance covered is 0.

The following assumptions may have the effect of making calculations more efficient and making the algorithm easier to implement on the telematics device 101: (1) time dependence: where $\Omega$ depends only on the length of the time slice, i.e. the driving time period; and (2) spatial dependence: where $\Omega$ depends only on the road category, i.e. the street category.

Let $\Omega^{\alpha\beta}$ be defined according to the assumptions (1) and (2). Thus, $$0 \leqq \alpha \leqq n,\ 0 \leqq \beta \leqq m \text{ with}$$

$$\Omega(t, \vec{x}_t, v, v^m) \sum_{\alpha\beta} \Omega^{\alpha\beta}(v, v^m) 1^{\alpha\beta}(t, \vec{x}_t) \qquad \text{Equation (2)}$$

where $1^{\alpha\beta}(t, \vec{x}_t)$ specifies the characteristic function.

Assumptions (1) and (2) enable the simplified calculation of the summation $\Omega^{\alpha\beta}$ from $\Omega$. Accordingly, $\Omega^{\alpha\beta}$ is only dependent upon the velocity of the vehicle 102 and the allowed maximum velocity.

To calculate an integral $$\int_s \Omega^{\alpha\beta}$$

a LeDesgue/Riemann approximation (discretization) with a special decomposition may be applied. In the following, $v^m$ may be understood to refer to an allowed maximum velocity, including an additional velocity (i.e. a total velocity), such that if the user 108 drives at the total velocity, he will incur an associated penalty. For example, if the speed limit is 50 km/h, and an associated penalty is incurred for driving 30 km/h over the speed limit, $v^m$ is 80 km/h.

Let $I=\cup[v_i, v_{i+1})$ be a disjunctive decomposition of the interval $[0, v^{max}] \subset \mathbb{R}$. Then, $$s_{ij} := \{s | v_i \leqq v(s) < v_{i+1} \wedge v^M_j \leqq v^M(s) < v^M_{j+1}\} \qquad \text{Equation (3)}$$

may define a decomposition of s.

For the disjunctive decomposition $I=\cup[v_i, v_{i+1})$ the corresponding Riemann approximation $R^{\alpha\beta}_I$ applies:

$$R^{\alpha\beta}_I = Tr(\Omega^{\alpha\beta} \circ \Lambda^{\alpha\beta}) = \sum_{ij} \Omega^{\alpha\beta}_{ij} \Lambda^{\alpha\beta}_{ji} \xrightarrow[\Delta(I) \to 0]{} \int_s \Omega^{\alpha\beta} \circ \varphi \, ds = \omega(s) \qquad \text{Equation (4)}$$

where the matrix $\Lambda^{\alpha\beta}$ is defined as follows ($\Pi_{\alpha\beta}$ designates a projection onto the time slice and the road category and/designates a length, i.e. the length of the distance covered)

$$\Lambda^{\alpha\beta}_{ij} := l(\Pi_{\alpha\beta}(s_{ij})) \quad \text{Equation (5)}$$

It may be a characteristic of the decomposition described above that it can be efficiently computed by the telematics device 101. The telematics device 101 may calculate the matrix $\Lambda^{\alpha\beta}$, and send calculated matrices at regular intervals to the SDP 106. At the SDP, the matrices will be processed according to equation (5). This may of the advantage that the configuration of parameters for each speed matrix is carried out at the SDP 106.

Each successive row of the speed matrix $\Lambda^{\alpha\beta}$ may correspond to driving performed at an increasing speed limit. Also, each successive column of the speed matrix may correspond to an increasing velocity range. The speed limit and the velocity range may be understood as circumstances of movement. Thus, each entry in the speed matrix may represent a distance travelled in an area with the speed limit defined by the row, and where the vehicle 102 was driving at a speed in the velocity range defined by the column.

For example, a 3 row and 3 column speed matrix sent from the telematics device 101 may contain the following values:

$$\Lambda = \begin{pmatrix} 21 & 12 & 13 \\ 56 & 14 & 3 \\ 0 & 0 & 0 \end{pmatrix}$$

Each successive row of the matrix above represents a 50 km/h difference in speed limit (from 50 km/h at the first row to 150 km/h at the third row). Each successive column represents a 50 km/h difference in speed range (from 0-50 km/h at the first column to 100-150 km/h as an example of a circumstance of movement at the third column). Consequently, the pair of circumstances of movement for the matrix entry at row 1 column 1 are a velocity range of 0-50 km/h and a speed limit of 50 km/h, where the value of the matrix entry is 21 km. Thus, according to the matrix above, the vehicle 102 was driven 119 km in the time slice covered by the matrix, i.e. the plurality of matrix entries defines the distance covered by the device during the time period as 119 km. A time slice may be understood as a predetermined period (e.g. a day, or two days).

The entry at row 1, column 1 indicates that 21 km were covered at a speed between 0 and 50 km/h (where the range of 0 to 50 km/h is an exemplary circumstance of movement), in an area where the legally prescribed speed limit is 50 km/h (where the speed limit of 50 km/h is an exemplary circumstance of movement). In addition, the entry at row 2, column 1 shows that the vehicle 102 was driven 56 km at a speed between 0 and 50 km/h, in an area where the speed limit is 100 km/h (the speed range of 0 to 50 km/h and the speed limit of 50 km/h are examples of circumstances of movement). The entry at row 1, column 2 shows that the vehicle 102 was driven 12 km at a speed of between 50 and 100 km/h, in an area where the legally prescribed speed limit is 50 km/h. The 12 km represented in row 1, column 2, the 13 km represented in row 1, column 3 and the 3 km represented in row 2, column 3 of the matrix above indicate speed limit violations. Since the vehicle was not driven in an area with a speed limit of 150 km/h, this row of the matrix is filled with 0s.

In the example above, the intervals are large and the matrix is small for illustrative purposes. Another implementation might include intervals for rows and columns of less than 10 km/h. Thus, the speed matrix might have at least 15 rows and/or at least 15 columns and 225 entries.

The speed matrices $\Lambda^{\alpha\beta}$ calculated by telematics device 101 may be generated using code based on the pseudocode in Table 2.

TABLE 2

```
//sample frequency usually 1 sec (GPS Chip)
while driving repeat:
    //locate position using GPS
    x = getGPS( )
    //match x to map
    x = match(x)
    //get speed limit from map
    vm = getSpeedLimitFromMap(x)
    //get speed VTG from GPS via Doppler shift
    v = getVTG( )
    //discretize vm and v
    i = lookupDiscretizationTable(v)
    j = lookupDiscretizationTable(vm)
    //compute time slice and street category
    t = currentTime( )
    a = lookupTimeSlice(t)
    b = lookupStreetCategory(x)
    //compute distance from last known position
    y = getLastPosition( )
    s = computeLength(x, y)
    //increment lambda with s
    lambda(a, b, i, j) = lambda(a, b, i, j) + s
    //store position as last position
    setLastPosition(x)
```

Additional code may be used to upload the matrix to the SDP 106 and reset the values of the matrix to 0.

A weighted speed matrix $\Omega^{\alpha\beta}$ may be calculated at the SDP 106. $\Omega^{\alpha\beta}$ may have one or more of the following restrictions:

(1) $\Omega^{\alpha\beta}$ is not negative, i.e. $\Omega^{\alpha\beta}_{ij} \geqq 0\ \forall i, j$.

(2–monotonicity) $\forall i$: $\Omega^{\alpha\beta}_{ij} \geqq \Omega^{\alpha\beta}_{ij'}$ $j>j'$, i.e. a speeding violation is given a weight that grows in proportion to the difference between the speed limit and the velocity of the vehicle 102.

(3—scaling) $\forall j$: $\Omega^{\alpha\beta}_{ij} \leqq \Omega^{\alpha\beta}_{i'j}$ $i>i'$, i.e. as the velocity of the vehicle 102 becomes greater, an absolute speeding violation becomes less relevant.

(4—threshold value) $\Omega^{\alpha\beta}_{ij}=0\ \forall i \leqq j$, i.e. only velocities that exceed the speed limit will be evaluated.

The application of restriction (4—threshold value) may have the effect of increasing the efficiency of calculating $\Omega^{\alpha\beta}$.

Equation (1), the velocity measurement of s, may be linear with respect to the distance covered. This may be understood to mean that a substantial distance (i.e. a large number of kilometres covered) results in a substantial (i.e. high) velocity measurement. Thus, the normalization equation (6) follows.

$$\tilde{\omega}(s) := \frac{\omega(s)}{l(s)} \quad \text{Equation (6)}$$

Equation (6) may be referred to as the velocity score of s. The velocity score may be used as the basis for further analysis and may influence fees changed by the service provider 107 to the customer 108.

Another type of matrix sent from the telematics device 101 to the SDP 106 may be a matrix summarizing ecological driving behaviour, i.e. the ecological matrix. The ecological matrix may reflect the driving behaviour of the user 108 with regard to fuel consumption, where fuel consumption may be a function of the velocity of the vehicle 102 and the acceleration of the vehicle 102 (including negative acceleration).

In some implementations, the rate of acceleration may be determined using a sensor in the vehicle 102. The rate of acceleration could also be calculated based on a change in velocity over a period of time.

Let s: $\mathbb{R} \rightarrow \mathbb{R}^3$ define the parameterization of the distance covered, as described above with respect to the speed matrix. Furthermore, let v: $\mathbb{R} \rightarrow \mathbb{R}$ with $$v(t) := \frac{d}{dt}|\bar{x}_t| = \frac{d}{dt}x_t$$

being the velocity of the vehicle 102 and let a: $\mathbb{R} \rightarrow \mathbb{R}$ with $$a(t) := \frac{d}{dt}v_t = \frac{d^2}{dt^2}x_t$$

being the acceleration. The parameter space of velocity× acceleration may be defined as $\mathbb{R} \times \mathbb{R}$. Thus, ϕ: $\mathbb{R} \rightarrow \mathbb{R} \times \mathbb{R}$ with ϕ(t):=(v, a).

An evaluation of the distance covered by the vehicle 102 may be realized using a general weight function Θ as an integral curve of the distance covered as follows:

Let Θ(v, a): $\mathbb{R} \times \mathbb{R} \rightarrow \mathbb{R}^2$ be the weight function, then $$\vartheta(s) := \int_s \Theta \circ \varphi \, ds = \int_t \Theta \circ \varphi |\vec{v}| dt \qquad \text{Equation (7)}$$

defines the ecological measurement of s. θ is a linear function. That means θ has the following properties (3 and 4):

$$\theta(s \cup s') = \theta(s) + \theta(s') \qquad \text{Property (3)}$$

In other words, θ is linear relative to position components of the distance covered. In addition, $$\theta(s) = 0 \text{ when } l(s) = 0 \qquad \text{Property (4)}$$

In other words, θ is 0 when the distance covered is 0.

A discretization of $[0, v^{max}] \times [a^{min}, a^{max}] \subset \mathbb{R} \times \mathbb{R}$ may be defined as follows $$s_{ij} := \{s | v_i \leqq v(s) < v_{i+1} \wedge a_j \leqq a(s) < a_{j+1}\} \qquad \text{Equation (8)}$$

where equation (8) defines a decomposition of s. It is possible that $a^{min}$ can be less than 0, since negative acceleration (i.e. braking) can occur. This contrasts with velocity, which is always positive.

For $s_{ij}$, the corresponding Riemann approximation $R_l$ applies:

$$R_l = Tr(\Theta \circ \Lambda) = \sum_{ij} \Theta_{ij} \Lambda_{ji} \xrightarrow[\Delta(l) \to 0]{} \int_s \Theta \circ \varphi \, ds = \vartheta(s)$$

where the matrix Λ is defined the same way as $\Lambda^{\alpha\beta}$ in equation (5).

Each successive row of the ecological matrix Λ may correspond to driving performed at an increasing velocity range. Also, each successive column of the ecological driving behaviour matrix may correspond to an increasing acceleration. Thus, each entry in the ecological driving behaviour matrix may correspond to a distance driven in a specified range of velocities, at a specific rate (or level) of acceleration. The velocity range and the rate of acceleration may be understood as circumstances of movement.

For example, a 3 row and 9 column ecological matrix sent from the telematics device 101 may contain the following entries:

$$\Lambda = \begin{pmatrix} 0 & 0 & 3 & 8 & 30 & 10 & 3 & 0 & 0 \\ 0 & 0 & 4 & 20 & 100 & 30 & 5 & 0 & 0 \\ 1 & 0 & 8 & 11 & 20 & 10 & 1 & 0 & 0 \end{pmatrix}$$

Each successive row differs from the previous row by 50 km/h, i.e. there are 50 km/h steps between the rows. Thus, the first row defines a velocity range of 0-50 km/h, where the velocity range of 0-50 km/h is an exemplary circumstance of movement. The second row defines a velocity range of 50-100 km/h, and the third row defines a range of 100-150 km/h, where the velocity ranges of 50-100 km/h and 100-150 km/h are exemplary circumstances of movement. Each successive column differs from the previous column by 1 m/s$^2$, with a minimum value of −4 m/s$^2$ (column 1) and a maximum value of 4 m/s$^2$ (column 9). The values of −4 m/s$^2$ (column 1) and 4 m/s$^2$ (column 9) are exemplary circumstances of movement. Each entry in the matrix defines a number of kilometres driven within the velocity range defined by the row and at the acceleration defined by the column. Consequently, the pair of circumstances of movement for the matrix entry at row 1 column 1 are a velocity range of 0-50 km/h and a negative acceleration of −4 m/s$^2$, and the value of the matrix entry is 0.

According to the example, the vehicle 102 was driven 267 km in the time slice for which the matrix is defined (i.e. the time slice covered by the matrix). This can be determined simply by adding up the values in the matrix. Furthermore, the entry in row 2, column 5 of the matrix above shows that the vehicle 102 was driven 100 km at a velocity (i.e. speed) of between 50-100 km/h with an acceleration of less than 1 m/s$^2$. In addition, the entry at row 3, column 1 of the matrix above shows that the vehicle 102 was driven 1 km at a velocity of between 100-150 km/h with an acceleration of −4 m/s$^2$.

It is not necessary for the ecological matrix to be symmetrical. For example, it may be advisable to define columns beginning with a minimum value of −10 m/s$^2$, i.e. the maximum deceleration of a vehicle with the brakes fully applied, and ending with a maximum value of 6 m/s$^2$, which corresponds to a vehicle accelerating from 0 to 100 km/h in 5 seconds. In normal traffic situations, acceleration of up to 2 m/s$^2$ and deceleration of not less than −2 m/s$^2$ is customary.

The ecological matrix may be calculated using code based on pseudocode shown in Table 3. In the pseudocode shown in Table 3, the acceleration of the vehicle 102 is calculated based on a change of the velocity of the vehicle 102. However, other implementations, e.g. the use of a sensor to detect the acceleration of the vehicle 102, are possible.

TABLE 3

```
//sample frequency usually 1 sec (GPS Chip)
while driving repeat:
    //locate position using GPS
    x = getGPS( )
    //match x to map
    x = match(x)
    //get speed VTG from GPS via Doppler shift
    v = getVTG( )
    //store as last velocity
    vl = v
    //compute acceleration (assuming sample frequency is 1 sec)
```

TABLE 3-continued

```
ac = v−vl
//discretize v and ac
i = lookupDiscretizationTable(v)
j = lookupDiscretizationTable(ac)
//compute time slice and street category
a = lookupTimeSlice(t)
b = lookupStreetCategory(x)
//compute distance from last known position
y = getLastPosition( )
s = computeLength(x, y)
//increment lambda with s
lambda(a, b, i, j) = lambda(a, b, i, j) + s
//store position as last position
setLastPosition(x)
```

Additional code may be used to upload the ecological matrix Λ to the SDP 106 and reset the values of the matrix entries to 0.

A weighted ecological matrix Θ may be calculated at the SDP 106. Θ may have one or more of the following restrictions:

(1) Θ is not negative, i.e. $\Theta_{ij} \geqq 0\ \forall i, j$ (2—monotonicity) $\forall i$: $\Theta_{ij} \geqq \Theta_{ij'}$, $j>j'$ acceleration is given a weight that grows in proportion to the magnitude of the acceleration (3—scaling) $\forall j$: $\Theta_{ij} \geqq \Theta_{i'j}$ $i>i'$ i.e. as the velocity of the vehicle 102 becomes greater, the magnitude of the acceleration becomes more relevant (4—ideal speed) $\Theta_{ij}=0\ \forall i_{min} \leqq i \leqq i_{max}$ Restriction (4) reflects the information that most passenger cars, when driven at a velocity of between e.g. 70-100 km/h, consume a low amount of fuel.

The function defined in equation (7), i.e. the ecological measurement of s, may be linear relative to the distance covered. This means, that a substantial distance (i.e. a large number of kilometres covered) results in a substantial (i.e. high) ecological measurement. Thus, the normalization equation (9) follows:

$$\tilde{\vartheta}(s) := \frac{\vartheta(s)}{l(s)} \qquad \text{Equation (9)}$$

Equation (9) may be referred to as the ecological score of s. The ecological score may be used as a basis for further analysis and may influence fees charged by the service provider 107 to the customer 108.

Yet another type of matrix sent from the telematics device 101 to the SDP 106 may be a matrix summarizing (or aggregating) risks corresponding to categories of roads on which the vehicle 102 is driven and risks corresponding to times of day the vehicle 102 is driven (i.e. the risk matrix). Thus, a road category and a time of day the vehicle 102 is driven may be understood as a pair of circumstances of movement. The road category of a road corresponding to a position may be determined based on whether the road is in a city (i.e. urban area) or outside of a city. The risk matrix may be defined as follows.

Let $\Delta_{\alpha\beta}:=l(\Pi_{\alpha\beta})$ be a measure of the distance covered (or traversed) in a time period (i.e. time slice) α on a road with corresponding category β. Let $P^{\alpha\beta}$ be any compatible matrix. Then $$p := \sum P^{\alpha\beta}\Delta_{\alpha\beta} \qquad \text{Equation (10)}$$

Equation (10) defines the risk measurement of s.

The matrix $P^{\alpha\beta}$ has the following property:

$$P^{\alpha\beta} \text{ is not negative, i.e. } P^{\alpha\beta}_{ij} \geqq 0\ \forall i,j \qquad \text{Property (5)}$$

The result of equation (10) corresponds linearly to the distance covered. This means that a large distance covered (i.e. a substantial number of kilometres) results in a high risk measurement.

The equation $$\tilde{\rho}(s) := \frac{\rho(s)}{l(s)} \qquad \text{Equation (11)}$$

is referred to as the risk score of s.

The risk score may influence fees charged by the service provider 107 to the user 108. The risk matrix may be implemented on the telematics device 101 using code based on the pseudocode in Table 4.

TABLE 4

```
//sample frequency usually 1 sec (GPS Chip)
while driving repeat:
    //locate position using GPS
    x = getGPS( )
    //match x to map
    x = match(x)
    //compute time slice and street category
    a = lookupTimeSlice(t)
    b = lookupStreetCategory(x)
    //compute distance from last known position
    y = getLastPosition( )
    s = computeLength(x, y)
    //increment lambda with s
    lambda(a, b) = lambda(a, b) + s
    //store position as last position
    setLastPosition(x)
```

Additional code may be used to upload the risk matrix to the SDP 106 and reset the values of the matrix entries to 0.

The speed matrix, the ecological matrix, and the risk matrix may each include a plurality of matrix entries. Each matrix entry may be composed of a plurality of elements. For example, the entry at row 2, column 1 of the speed matrix has the value 56 km. 56 km may be understood as the distance covered under the pair of circumstances of movement defined by row 2, column 1 (i.e. a speed limit of 100 km/h and a speed range of between 0-50 km/h). A time period, programmed into the device, is defined as one day. According to the example, the matrix entry with the value of 56 km is composed of 3 elements. The first element was recorded in the matrix entry when the user 108 drove the vehicle 102 20 km at 40 km/h in an area where the speed limit was 100 km/h. The second element was recorded later in the time period when the user 108 drove the vehicle 102 20 km at 30 km/h in a different area where the speed limit was also 100 km/h. The third element was recorded even later in the time period when the user 108 drove the vehicle 102 16 km at 35 km/h in yet another area where the speed limit was 100 km/h. Other elements of different matrix entries may have been recorded while the elements of the example were recorded.

In some situations, it may be that position data is uploaded to the SDP 106 along with one or more matrices. The position data may be uploaded when the user performs an action with an associated consequence. The action may be risky driving behaviour (e.g. exceeding a speed limit), driving behaviour with adverse environmental consequences (e.g. a high rate of acceleration), driving in a dangerous area (e.g. an icy area) or driving at a dangerous time of day (e.g. at night). The consequence may be an increase in the fee changed to the user 108 by the service provider 107. When the position data is uploaded to the SDP 106, the position data may be encrypted with a secret key of the user. Encrypting position data with the secret key of the user may have the effect of protecting the privacy of the user. The user 108 may choose to allow the SDP 106 or the service provider 107 to decrypt the position data in order to avoid paying additional fees (e.g. the user may be able to use the position data to show that he was not at the position at the time the action occurred).

The SDP 106 may confirm receipt of the event message at S802. At S803, in an additional message or in the same confirmation message, the SDP 106 may provide a URL for a new configuration for telematics device 101. The URL may be used to download the new configuration. A code may be provided in the message sent at S803 to indicate that the data sent at S801 was accepted and processed. Alternatively, a message may be sent at S804 indicating whether a new configuration is available for download by the telematics device 101, and that the event data sent at S801 could not be processed.

It may be that the SDP 106 aggregates data from several telematics devices (including telematics device 101) and performs statistical analysis on the aggregated data before forwarding the aggregated data to the service provider 107. The statistical analysis performed by the SDP 106 may involve aggregation of data similar to the aggregation described above in connection with the three exemplary matrices (i.e. the matrices for speed, ecological driving behaviour, and risk). One distinguishing feature of the statistical analysis performed at the SDP 106 may be that it takes place over a longer time period, e.g. a week. For example, 7 risk matrices from the telematics device 101 can be sent to the SDP 106 over the course of a week. At the end of the week, the SDP 106 aggregates the 7 matrices into one matrix (possibly by adding up the corresponding values), and then sends the result to the service provider 107.

It may be that the SDP 106 stores the speed, ecological, and risk matrices. In practice, the matrices may be sparse, since some drivers do not drive in the early morning, and entries corresponding to this time slice may all be 0. Also, a number of speeding violations, e.g. 100 km/h in the centre of a city, are rare. It may be advisable to compress the matrices with sparse block compressed row storage or Harwell-Boeing format before storing the matrices, and possibly before transmitting the matrices from the telematics device 101 to the SDP 106. Thus, it may be possible to reduce bandwidth consumed by sending matrices by compressing the matrices (e.g. eliminating or reducing matrix entries with a value of 0) or not sending matrices when the matrix entries are all 0.

The speed, ecological and risk matrices may be transmitted from the telematics device 101 to the SDP 106 in XML format. In order to minimize the quantity of data sent, and thereby minimize the cost of transmitting the data, matrix data may be transmitted in an XML list format. For example, the 3 row and 9 column ecological matrix Λ from the example above, may be represented as shown in Table 5:

TABLE 5

```
<set>
    <speed>
        <cat>1</cat>
        <time>1</time>
        <!-- using list for efficiency -->
        <items>
```

TABLE 5-continued

```
0 0 3 8 30 10 3 0 0
0 0 4 20 100 30 5 0 0
1 0 8 11 20 10 1 0 0
        </items>
    </speed>
</set>
```

In a specific example, a binary XML format and/or a compression utility (e.g. gzip) may be used. In some implementations, it may be that WBXML, possibly in combination with the compression utility, could be suitable. A compression ratio of 20% with WBXML and 40-50% with the compression utility may be realistic. A further alternative may be the use of ASN.1 instead of XML. Although the use of the compression utility may be particularly helpful in reducing the quantity of data transmitted, there may be performance considerations due to the demands of compression and decompression on the telematics device 101.

The speed, ecological and risk matrices may be sent individually or combined into a multidimensional matrix. For example, a three dimensional matrix, in particular a three dimensional speed matrix might include 7 one day times slices, with a two dimensional matrix for each time slice. Thus, according to the example, the three dimensional matrix would include 7 two dimensional matrices. Other combinations are possible. For example, a four dimensional matrix might include multiple three dimensional matrices, such as multiple three dimensional speed matrices for each road category. Continuing the example, the four dimensional matrix may include two entries, one for a city road category, and one for a non-city road category. Each entry may include multiple three dimensional matrices.

Figure 9:
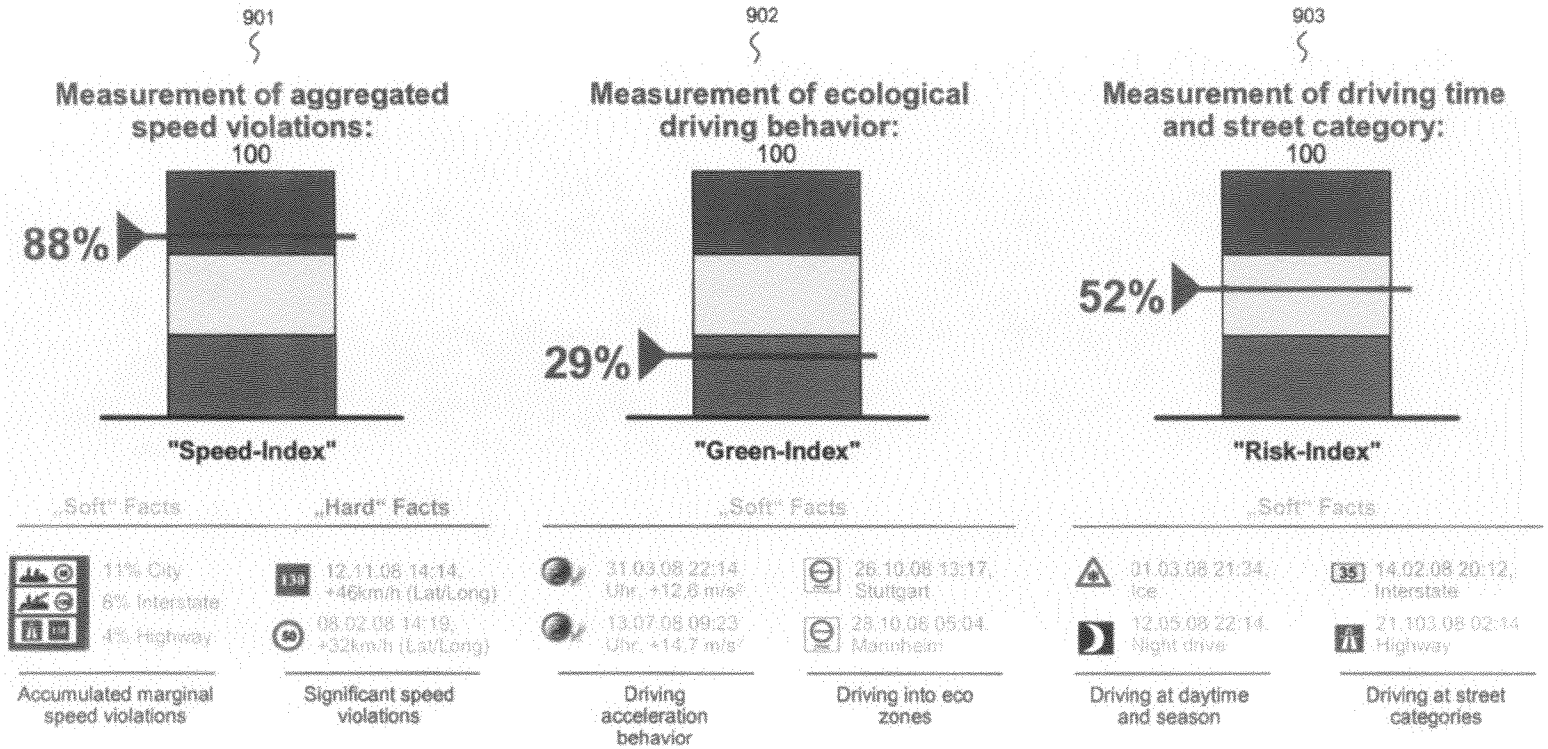
FIG. 9 shows a display of data that may be transmitted from Service Delivery Platform to a service provider.

FIG. 9 shows an exemplary display of data that may be transmitted from SDP 106 to the service provider 107. The data may have been received from a plurality of telematics devices, possibly including telematics device 101. The data may include speed limit violation data 901, ecological driving behaviour data 902, and driving risk factor data 903. Speed limit violation data 901 may include accumulated marginal speed limit violations, or "soft facts", which may be measured as percentages. In addition, speed limit violation data 901 may include significant speed limit violations or "hard facts", which may be provided individually. The measurement of ecological driving behaviour data 902 may provide a record of predetermined events. For example, instances of high acceleration may be recorded along with periods when the vehicle 102 is driven into an environmental zone. Driving risk factor data 903 may record driving in areas or at times (e.g. at night) when accidents frequently occur.

Figure 10:
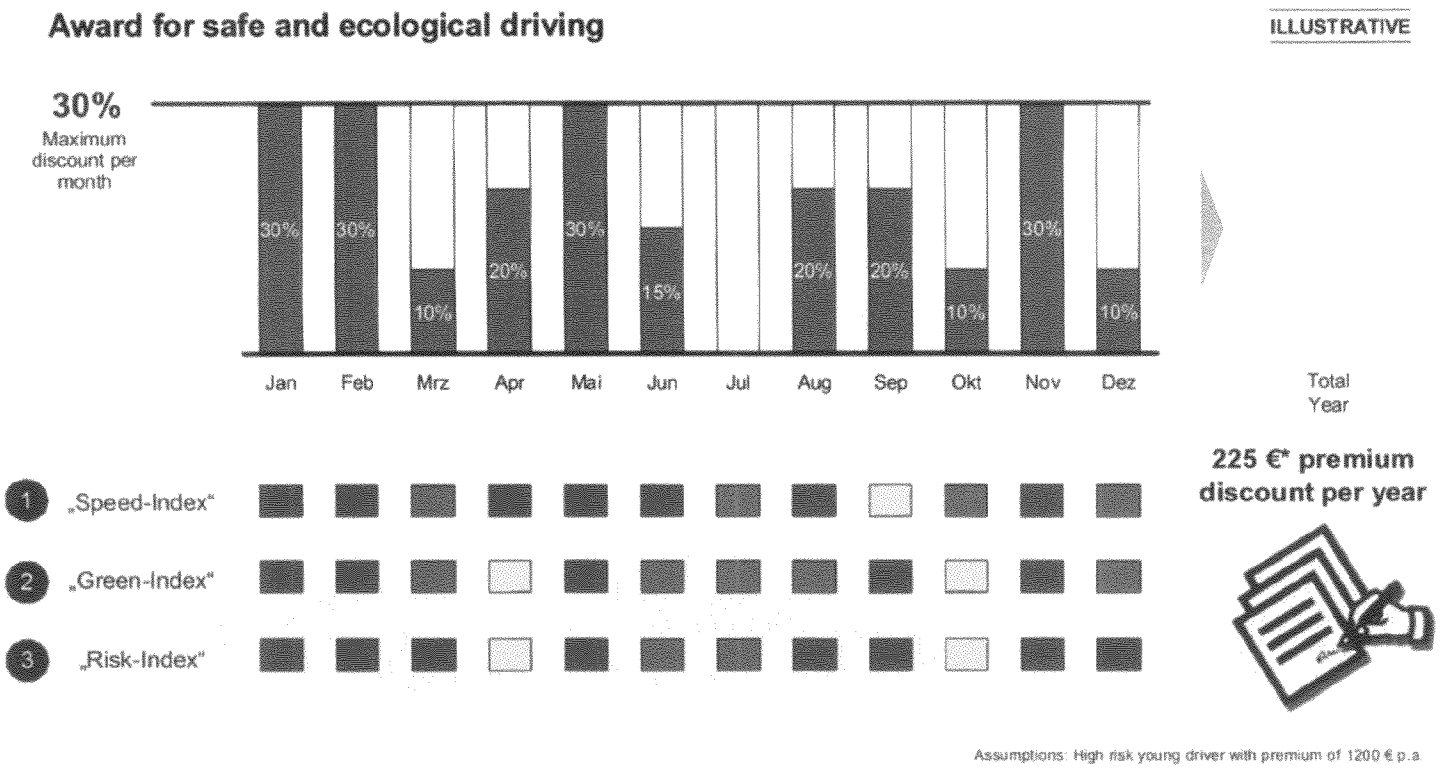
FIG. 10 graphically depicts possible benefits of using the telematics device.

FIG. 10 graphically depicts possible benefits of using the telematics device 101.

According to some studies, it is common for drivers to exceed a recommended speed if there is no speed limit on a highway. Furthermore, casualties in accidents are particularly high for young drivers. These and other factors contribute to high damage claims and decreasing premiums in some automobile insurance markets.

Furthermore, it is sometimes suggested that it is difficult to differentiate the auto insurance policies of one company from the auto insurance policies of competing companies when each insurance company is legally obliged to offer auto insurance to any person who asks for it. As a result, auto insurance companies may struggle with high user turnover and user price sensitivity. Furthermore, costs for damages and risk factors for individuals may not be transparent. Insurance premiums may be calculated based on the characteristics of a segment of consumers. These issues may limit the growth potential of the auto insurance market and create a need to determine driving behaviour more precisely.

Figure 12:
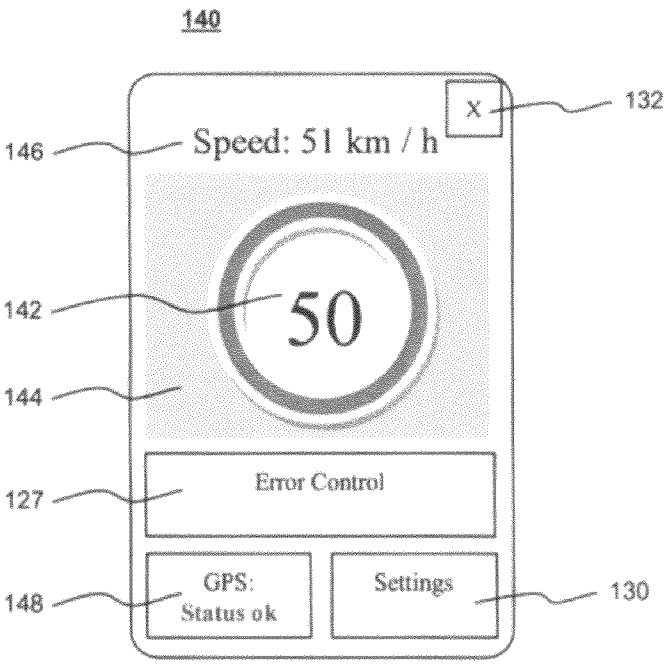
FIG. 12 depicts an exemplary warning display from the GUI of the telematics device.
Figure 11:
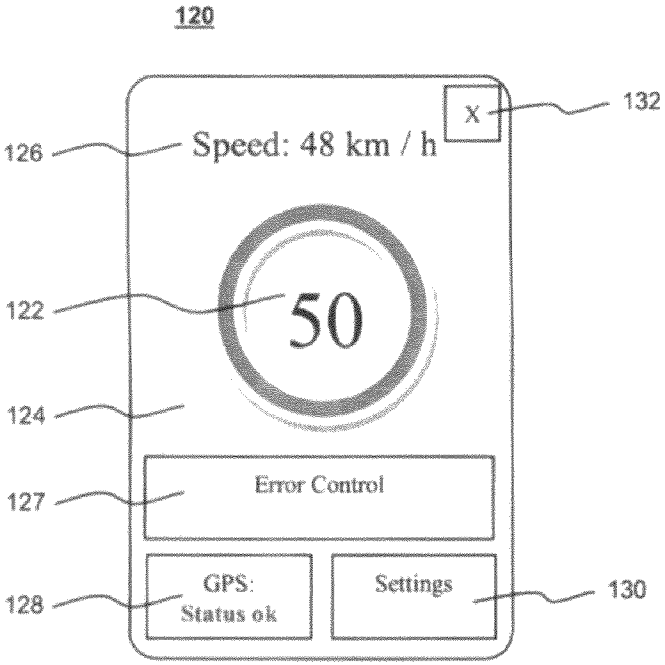
FIG. 11 depicts an exemplary speed display from the GUI of the telematics device.
Figure 13:
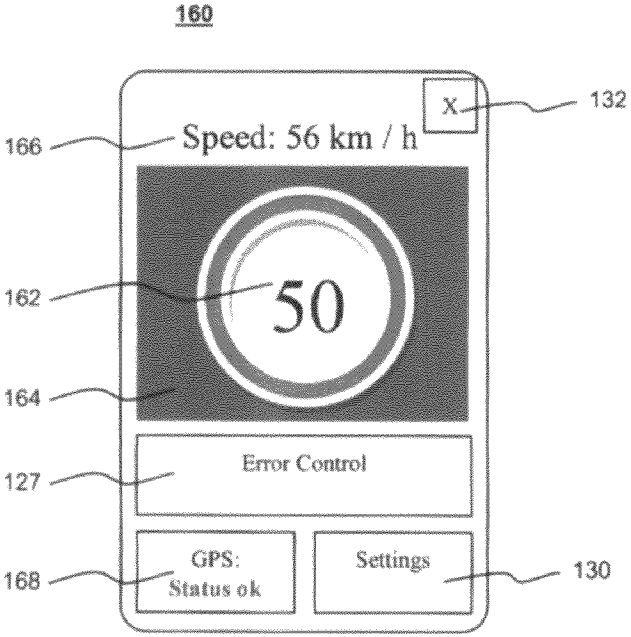
FIG. 13 shows an exemplary alert display from the GUI of the telematics device.

FIGS. 11, 12 and 13 depict different aspects of a speed display. Similar displays, with corresponding settings and extended displays, may be provided to depict ecological driving behavior, road category risk, and risk relative to the time of day the vehicle 102 is driven.

FIG. 11 depicts an exemplary speed display 120 of the GUI of the telematics device 101. The speed display 120 includes a speed limit indicator 122 against a white background 124. The white background 124 of the speed limit indicator 122 may be understood to indicate that the vehicle 102 is moving at a velocity within a speed limit corresponding to a location of the vehicle 102. A velocity indicator 126 shows that the velocity of the vehicle 102 is 48 km/h. An error control input element 127 allows the user 108 to record violations (e.g. speed limit violations) that are not reported by the telematics device 101. A GPS status indicator 128 indicates a status of a signal from the satellite 104. For example, if the telematics device 101 is currently receiving a signal from the satellite 104, the GPS status indicator 128 indicates "Status ok". If the telematics device is not currently receiving a signal from the satellite 104, the GPS status indicator 128 might indicate "no signal". A settings input element 130 may be used to show a settings display, e.g. the settings display 180 depicted in FIG. 14, on the telematics device 101. An X input element 132 may be used to close the GUI and the driving analysis application on the telematics device 101. Accessing the X input element 132 may have the effect of stopping the performance of driving analysis functions on the telematics device 101, as described in the present application.

FIG. 12 depicts an exemplary warning display 140 of the GUI of the telematics device 101. The warning display 140 may be understood as a variation of the speed display 120. In the warning display 140, the speed limit indicator 142 is displayed against a yellow background 144. The yellow background 144 may be understood to indicate that a velocity of the vehicle 102 exceeds a speed limit corresponding to a location of the vehicle 102. However, in the example of warning display 140, the velocity of the vehicle 102 is within a preset tolerance of 5 km/h. The preset tolerance may be modified as discussed in connection with FIG. 14. A velocity indicator 146 shows that the velocity of the vehicle 102 is 51 km/h. The speed limit indicator 142 indicates that the speed limit corresponding to the location of the vehicle 102 is 50 km/h. Similar to the speed display 120, the warning display 140 includes the error control input element 127, a GPS status indicator 148, and the settings input element 130. The display 140 also includes the X input element 132.

FIG. 13 shows an exemplary alert display 160 of the GUI of the telematics device 101. The alert display 160 may be understood as a variation of the speed display 120. In the alert display 160, the speed limit indicator 162 is displayed against a red background 164. The red background 164 may be understood to indicate that a velocity of the vehicle 102 exceeds a speed limit corresponding to a location of the vehicle 102, and that the velocity is outside the preset tolerance of 5 km/h. As indicated with respect to FIG. 14, 5 km/h is an exemplary preset tolerance and may be modified. In addition to the red background 162, the telematics device 101 may emit audio feedback 103, indicating that a velocity outside the preset tolerance has been detected. The audio feedback 103 may be an audio signal such as a beep. Moreover, the audio feedback may indicate adverse consequence for the user 108, such as an increased insurance premium or an administrative fine.

A velocity indicator 166 shows that the speed of the vehicle 102 is 56 km/h. The speed limit indicator 162 shows that the speed limit corresponding to a location of the vehicle 102 is 50 km/h. Similar to the speed display 120 and the warning display 140, the alert display 160 includes an error control input element 127, a GPS status indicator 168, a settings input element 130, and an X input element 132.

Figure 14:
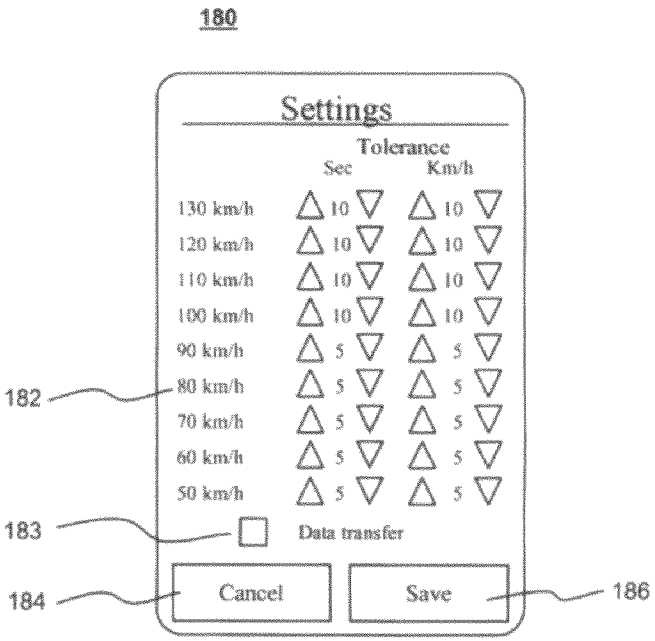
FIG. 14 depicts the exemplary settings display from the GUI of the telematics device.

FIG. 14 depicts the exemplary settings display 180 of the GUI of the telematics device 101. The settings display 180 may be shown after the user 108 clicks (or presses) the settings input element 130. The settings display 180 includes three columns and may be used to adjust the tolerance in time and velocity before the alert display 160, is shown. As in connection with FIG. 16, the alert display may be accompanied by audio feedback 103.

The leftmost column of the settings display 180 shows a list of velocities, in descending order, each entry corresponding to a speed limit relative to a location of the vehicle 102. The next two columns include headers "Sec" and "Km/h". The arrows on both sides of the entries in the "Sec" column and the "Km/h" column allow the entries to be increased or decreased. The entries in the "Sec" column refer to a seconds tolerance, i.e. a number of seconds a violation is detected before the alert display 160 is shown. The entries in the Km/h column refer to a speeding tolerance, i.e. a number of km/h the speed limit is exceeded before the alert display 160 is shown. The seconds tolerance and the speeding tolerance may be collectively referred to as tolerance values. It may be that a restart of the driving analysis application is required before changes to the tolerance values take effect. A cancel input element 184 may be used to return to the speed display 120, without saving any changes to the tolerance values. A save input element 186 may be used to record changes to the tolerance values and return to the speed display 120.

According to an example, the row 182 shows that if a speed limit is 80 km/h, the vehicle 102 must exceed the speed limit by at least 5 km/h for at least 5 seconds before the alert display 160 is shown. Accordingly, if the vehicle 102 exceeds the speed limit for less than 5 seconds or by less than 5 km/h, the warning display 140 is shown.

In addition, a data transfer input element 183 (e.g. a checkbox) may be provided. The data transfer input element 183 may allow the user 108 to select whether data will be transferred from the telematics device 101 to the SDP 106.

Figure 15:
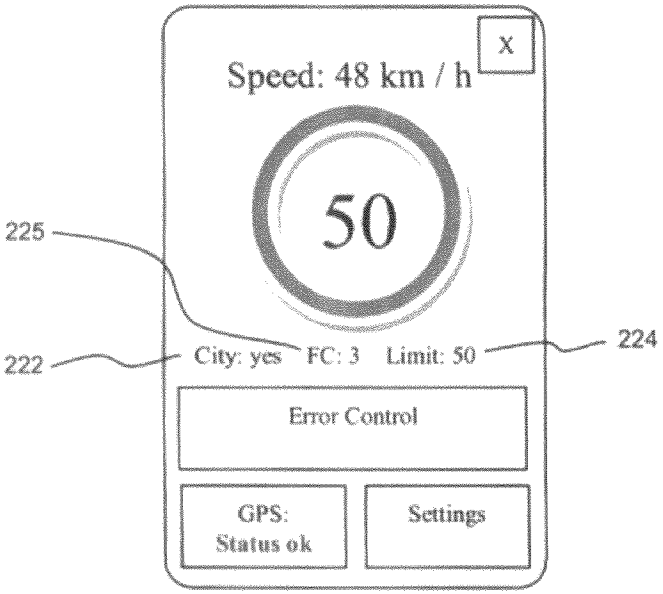
FIG. 15 shows an example of an extended speed display from the GUI of the telematics device.

FIG. 15 shows an example of an extended speed display 220. In addition to the elements of the speed display 120, the extended speed display 220 depicts a city indicator 222 and an limit indicator 224. The city indicator 222 indicates whether the vehicle 102 is located in an urban area. The limit indicator 224 indicates the speed limit corresponding to a location of the vehicle 102. The FC (Function Class) indicator 225 may refer to a road category corresponding to a location of the vehicle 102.

Figure 16:
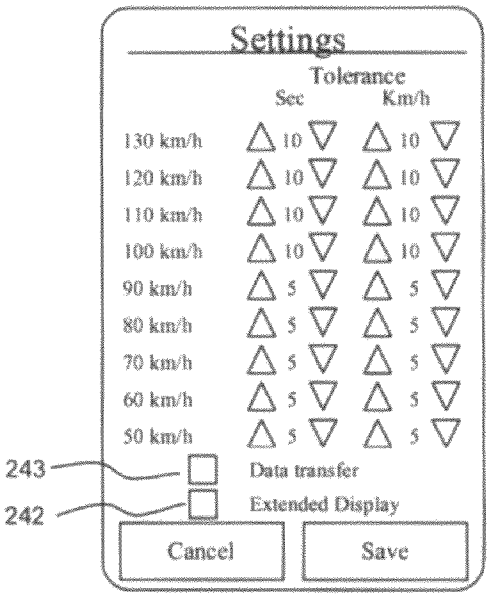
FIG. 16 shows an example of an extended settings display from the GUI of the telematics device.
Figure 17:
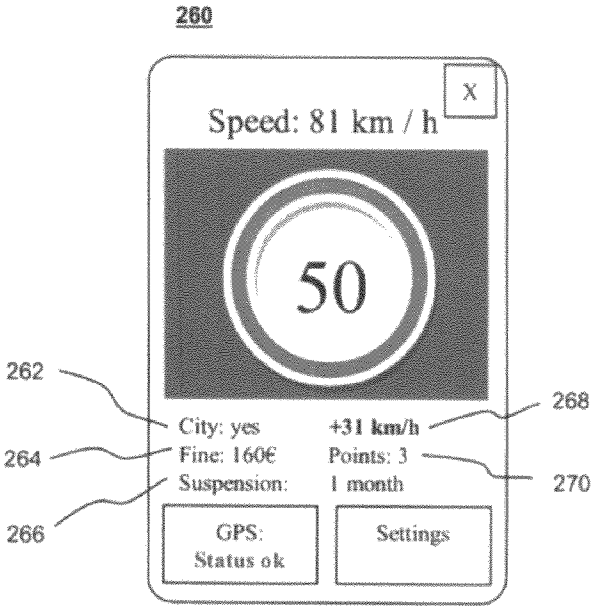
FIG. 17 shows an example of an extended alert display from the GUI of the telematics device.

FIG. 16 shows an example of an extended settings display 240. In addition to the elements of the settings display 180, the extended settings display 240 provides an extended display input element 242 (e.g. a checkbox) that allows a user to select whether or not extended information, as depicted in FIGS. 15 and 17, should be shown. Similar to the data transfer input element 183 of FIG. 14, the data transfer input element 243 may allow the user 108 to select whether data will be transferred from the telematics device 101 to the SDP 106.

FIG. 17 shows an example of an extended alert display 260. In addition to the elements of the alert display 160, the extended alert display 260 includes a city indicator 262, a fee indicator 264, a penalty indicator 266, a violation indicator 268, and a points indicator 270. Similar to the alert display 160, the extended alert display 260 may be accompanied by audio feedback 103. The city indicator 262 indicates whether the vehicle 102 is in an urban area. The fee indicator 264 shows the administrative fine corresponding to a violation depicted by the violation indicator 268. According to the example of FIG. 17, the violation is that the vehicle 102 exceeded a speed limit of 50 km/h by moving at a speed of 81 km/h, i.e. the vehicle 102 exceeded the speed limit by 31 km/h. The administrative fine may be understood as the fine prescribed by law for the violation. The penalty indicator 266 shows an additional penalty that may be prescribed for the violation. In the specific example of FIG. 17, the fee indicator 264 shows that the violation calls for a fine of 160 € and the penalty indicator 266 shows that the violation calls for a 1 month suspension of the driver's license of the user 108. Moreover, the points indicator 270 shows that the violation calls for 3 points to be recorded on the driver's license of the user 108. The telematics device 101 may also be configured to display a table of fines and penalties corresponding to violations in a locality.

The GUI of the telematics device 101 may also be configured to display index or summary information, similar to the information depicted in FIG. 9.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A computer-implemented method for ensuring the privacy of a user and the utility of data communicated by a device to a server, the method comprising:
- receiving data at the device during a time period;
- processing, by the device, the received data;
- summarizing, by the device, the processed data in a matrix, wherein the rows and columns of the matrix define circumstances of movement of the device, wherein the matrix includes a plurality of matrix-entries, and wherein each matrix-entry includes a distance covered by the device during the time period under a pair of circumstances of movement; and
- transmitting the summarized data from the device to the server.

2. The method of claim 1, wherein the predefined circumstances of movement comprise one or more of the following:
- a velocity range at which the device covered the distance;
- a rate of acceleration at which the device covered the distance;
- a speed limit corresponding to at least one position within the distance covered by the device;
- a road category corresponding to at least one position covered by the device.

3. The method of claim 1, wherein the processed data includes at least one of position data, velocity data, and time data, and wherein the velocity data indicates a speed at which the device has been moved, the method further comprising:
- correlating the position data and/or the velocity data and/or the time data with map information stored on the device;
- determining, by the device and based on the correlation, that the user has performed an action with an associated consequence;
- generating, by the device, an alert in response to the action; and
- displaying said alert to said user.

4. The method of claim 2, further comprising:
- encrypting, before transmission, the summarized data, wherein the summarized data can be decrypted by the server without assistance from the user;
- encrypting, before the transmission, the processed data corresponding to the action, wherein the processed data can only be decrypted with a key of the user; and
- transmitting the encrypted processed data from the device to the server.

5. The method of claim 2, wherein the map information comprises a set of map coordinates, and wherein correlating the position data and the velocity data further comprises:
- correlating the position data and the velocity data with a road category and/or a speed limit linked to the set of map coordinates.

6. The method of claim 2, wherein the action includes one or more of the following:
- exceeding a speed limit;
- exceeding a predefined rate of acceleration;
- approaching and or being at a position that presents a risk to the user.

7. The method of claim 2, wherein the device does not display the map information.

8. The method of claim 1, wherein the device is embedded in a vehicle, the method further comprising:
- compensating the user because the device is embedded in the vehicle.

9. The method of claim 1, wherein the matrix is used to calculate an indication of driving behavior.

10. The method of claim 1, further comprising:
- aggregating the transmitted data with data from at least one other device at the server;
- generating statistical data based on the aggregated data at the server; and
- providing a web portal, wherein the user is able to access the statistical data and/or the summarized data of the user by means of the web portal.

11. A computer-implemented method for ensuring the privacy of a user and the utility of data communicated by a device to a server, the method comprising:
- receiving data at the device during a time period;
- processing, by the device, the received data;
- summarizing, by the device, the processed data in a matrix, wherein the rows and columns of the matrix define circumstances of movement of the device, wherein the matrix includes a plurality of matrix-entries, and wherein each matrix-entry includes a distance covered by the device during the time period under a pair of circumstances of movement; and
- transmitting the summarized data from the device to the server wherein at least one matrix entry $E_{ij}$ is composed of a plurality of elements, wherein each element $e_{ij}^{k}$ of the plurality of elements defines a distance, wherein the distance defined by the element $e_{ij}^{k}$ may have been covered during a time interval which is nonadjacent to the time interval during which the distance defined by the next element $e_{ij}^{k+1}$ was covered, wherein the plurality of elements of each matrix entry defines the distance covered by the device during the time period under a pair of predefined circumstances of movement corresponding to said matrix entry, and wherein the plurality of matrix entries defines the distance covered by the device during the time period.

12. A device for ensuring the privacy of a user and the utility of data communicated by the device to a server, comprising:

a receiver operable to receive data during a time period, wherein the received data indicates that the device has been moved during the time period;

a processor operable to process the received data, and summarize the processed data in a matrix, wherein the rows and columns of the matrix define circumstances of movement of the device, wherein the matrix includes a plurality of matrix-entries, and wherein each at x-entry includes a distance covered by the device during a time period under a pair of predefined circumstances of movement; and a transmitter operable to transmit the summarized data to the server.

13. The device of claim 12, wherein the device is a mobile device.

14. The device of claim 12, wherein the device is physically embedded in a vehicle, and wherein the device uses an interface of the vehicle to communicate.

15. The device of claim 12, wherein the device is a vehicle telematics device.

16. The device of claim 13, wherein the mobile device is a mobile telephone.

17. A non-transitory-computer-readable medium for ensuring the privacy of a user and the utility of data communicated by a device to a server, comprising computer-readable instructions that, when loaded and executed on a device, cause the device to:

receive data at the device during a time period;

process, by the device, the received data;

summarize, by the device, the processed data in a matrix, wherein the rows and columns of the matrix define circumstances of movement of the device, wherein the matrix includes a plurality of matrix-entries, and wherein each matrix-entry includes a distance covered by the device during the time period under a pair of circumstances of movement; and transmit the summarized data from the device to the server.

18. The computer readable medium of claim 17, wherein the predefined circumstances of movement comprise one or more of the following:

a velocity range at which the device covered the distance;

a rate of acceleration at which the device covered the distance;

a speed limit corresponding to at least one position within the distance covered by the device;

a road category corresponding to at least one position covered by the device.

19. The computer readable medium of claim 17, wherein the processed data includes at least one of position data, velocity data, and time data, and wherein the velocity data indicates a speed at which the device has been moved, wherein the computer-readable instructions, when loaded and executed on the device, further cause the device to:

correlate the position data and/or the velocity data and/or the time data with map information stored on the device;

determine, by the device and based on the correlation, that the user has performed an action with an associated consequence;

generate, by the device, an alert in response to the action; and display said alert to said user.

20. The computer readable medium of claim 19, wherein the computer-readable instructions, when loaded and executed on the device, further cause the device to:

encrypt, before transmission, the summarized data, wherein the summarized data can be decrypted by the server without assistance from the user;

encrypt, before the transmission, the processed data corresponding to the action, wherein the processed data can only be decrypted with a key of the user; and transmit the encrypted processed data from the device to the server.

21. The computer readable medium of claim 19, wherein the map information comprises a set of map coordinates, and wherein correlating the position data and the velocity data further comprises:

correlating the position data and the velocity data with a road category and/or a speed limit linked to the set of map coordinates.

22. The computer readable medium of claim 19, wherein the action includes one or more of the following:

exceeding a speed limit;

exceeding a predefined rate of acceleration;

approaching and or being at a position that presents a risk to the user.

23. The computer readable medium of claim 19, wherein the device does not display the map information.

24. The computer readable medium of claim 17, wherein the device is embedded in a vehicle, and wherein the computer-readable instructions, when loaded and executed on the device, further cause the device to:

compensate the user because the device is embedded in the vehicle.

25. The computer readable medium of claim 17, wherein the matrix is used to calculate an indication of driving behavior.

26. The computer readable medium of claim 17, wherein the computer-readable instructions, when loaded and executed on the device, further cause the device to:

aggregate the transmitted data with data from at least one other device at the server;

generate statistical data based on the aggregated data at the server; and provide a web portal, wherein the user is able to access the statistical data and/or the summarized data of the user by means of the web portal.

27. A non-transitory computer-readable medium for ensuring the privacy of a user and the utility of data communicated by a device to a server, comprising computer-readable instructions that, when loaded and executed on a device, cause the device to:

receive data at the device during the time period;

process, by the device, the received data;

summarize, by the device, the processed data in a matrix, wherein the rows and columns of the matrix define circumstances of movement of the device, wherein the matrix includes a plurality of matrix-entries, and wherein each matrix-entry includes a distance covered by the device during a time period under a pair of predefined circumstances of movement; and transmit the summarized data from the device to the server, wherein at least one matrix entry $E_{ij}$ is composed of a plurality of elements, wherein each element $e_{ij}^{k}$ of the plurality of elements defines a distance, wherein the distance defined by the element $e_{ij}^{k}$ may have been covered during a time interval which is nonadjacent to the time interval during which the distance defined by the next element $e_{ij}^{k+1}$ was covered, wherein the plurality of elements of each matrix entry defines the distance covered by the device during the time period under the pair of predefined circumstances of movement corresponding to said matrix entry, and wherein the plurality of matrix entries defines the distance covered by the device during the time period.

28. A device for ensuring the privacy of a user and the utility of data communicated by the device to a server, comprising:

a receiver operable to receive data during a time period, wherein the received data indicates that the device has been moved during the time period;

a processor operable to process the received data, and summarize the processed data in a matrix, wherein the rows and columns of the matrix define circumstances of movement of the device, wherein the matrix includes a plurality of matrix-entries, and wherein each matrix-entry includes a distance covered by the device during a time period under a pair of predefined circumstances of movement; and a transmitter operable to transmit the summarized data to the server, wherein at least one matrix entry $E_{ij}$ is composed of a plurality of elements, wherein each element $e_{ij}^{k}$ of the plurality of elements defines a distance, wherein the distance defined by the element $e_{ij}^{k}$ may have been covered during a time interval which is non-adjacent to the time interval during which the distance defined by the next element $e^{ijk+1}$ was covered, wherein the plurality of elements of each matrix entry defines the distance covered by movement corresponding to said matrix entry, and wherein the plurality of matrix entries defines the distance covered by the device during the time period.

* * * * *

UNITED STATES PATENT AND TRADEMARK OFFICE

CERTIFICATE OF CORRECTION

PATENT NO. : 8,406,988 B2
APPLICATION NO. : 12/653976
DATED : March 26, 2013
INVENTOR(S) : Jörg Schäfer et al.

It is certified that error appears in the above-identified patent and that said Letters Patent is hereby corrected as shown below:

In the Claims:

Claim 12, col. 25, line 8, “wherein each at x-entry” should read --wherein each matrix-entry--.

Signed and Sealed this
Thirteenth Day of August, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,406,988 B2
APPLICATION NO. : 12/653976
DATED : March 26, 2013
INVENTOR(S) : Jörg Schäfer et al.

It is certified that error appears in the above-identified patent and that said Letters Patent is hereby corrected as shown below:

Claims

Please correct Claim 4 as follows:

Column 24, line 1, "The method of claim 2," should read -- The method of claim 3, --

Please correct Claim 5 as follows:

Column 24, line 11, "The method of claim 2," should read -- The method of claim 3, --

Please correct Claim 6 as follows:

Column 24, line 16, "The method of claim 2," should read -- The method of claim 3, --

Please correct Claim 7 as follows:

Column 24, line 22, "The method of claim 2," should read -- The method of claim 3, --

Signed and Sealed this
Thirty-first Day of May, 2016

Michelle K. Lee

Michelle K. Lee
*Director of the United States Patent and Trademark Office*